US011628554B2

(12) United States Patent
Resh

(10) Patent No.: US 11,628,554 B2
(45) **Date of Patent: *Apr. 18, 2023**

(54) TELEPOLE APPARATUS AND RELATED METHODS

(71) Applicant: Eric V. Resh, Temecula, CA (US)

(72) Inventor: Eric V. Resh, Temecula, CA (US)

(73) Assignee: RESH, INC., Murrieta, CA (US)

( * ) Notice: Subject to any disclaimer, the term of this patent is extended or adjusted under 35 U.S.C. 154(b) by 115 days.

This patent is subject to a terminal disclaimer.

(21) Appl. No.: 17/397,890

(22) Filed: Aug. 9, 2021

(65) Prior Publication Data

US 2022/0032443 A1 Feb. 3, 2022

Related U.S. Application Data

(63) Continuation of application No. 13/844,561, filed on Mar. 15, 2013, now Pat. No. 11,090,798, which is a (Continued)

(51) Int. Cl.

| | |
|---|---|
| ***B25G 1/04*** | (2006.01) |
| ***B25G 3/18*** | (2006.01) |
| ***B25G 3/20*** | (2006.01) |

(52) U.S. Cl.

CPC ..... *B25G 1/04* (2013.01); *B25G 3/18* (2013.01); *B25G 3/20* (2013.01)

(58) Field of Classification Search

CPC ..... B25G 1/102; B25G 1/10; B25G 1/105; B25G 1/00; B25G 1/01; B25G 1/04; (Continued)

(56) References Cited

U.S. PATENT DOCUMENTS 3,098,669 A * 7/1963 Fortin ..... B25G 1/04 248/188.5
3,407,424 A * 10/1968 Lanzarone ..... B25G 1/04 403/107

(Continued)

FOREIGN PATENT DOCUMENTS

EP 1523920 B1 4/2005

OTHER PUBLICATIONS

Letter from infringers Skimlite and the Conrads, dated Oct. 18, 2021.
Declaration of Eric Resh dated Feb. 7, 2022.

*Primary Examiner* — Robert J Scruggs
(74) *Attorney, Agent, or Firm* — J. Mark Holland & Associates; J. Mark Hollad; Alison Adnan

(57) ABSTRACT

An improved telepole device having attachment means for attaching swimming pool cleaning, and other tools. The improved telepole device preferably includes an inner tube which freely slides within an outer tube, and a locking device to temporarily secure the inner tube in a desired position within the outer tube. A preferred lightweight design may be at least partially hollow along the length of the tube(s), and durability may be provided by inner/reinforcement wall(s) that extend across the hollow portion(s) of one or both of the tubes. On the end of the outer tube through which the inner tube slides/extends is a collar element attached thereto and comprised of a locking device having a detent mechanism for "locking" the inner tube in place within the outer tube. Preferably, the collar's opening and the profile of the inner tube have one or more sides that, due to their relative position with respect to each other, can prevent the inner tube from rotating within the collar. Further, the inner tube preferably has a series of holes along its length which are positioned to receive a pin element of the detent mechanism. Further, the end of the outer tube (Continued)

opposite the collar preferably has attachment holes configured to receive attachable and detachable swimming pool cleaning tools, and an additional set of holes that allow water to drain from the outer tube while a tool is attached.

32 Claims, 22 Drawing Sheets

Related U.S. Application Data continuation-in-part of application No. 13/624,702, filed on Sep. 21, 2012, now Pat. No. 9,764,458.

(60) Provisional application No. 61/538,074, filed on Sep. 22, 2011.

(58) Field of Classification Search
CPC .... B25G 3/18; B25G 3/20; F04H 3/16; E04H 4/00; F16D 1/10; F16B 7/10; A01K 75/00
See application file for complete search history.

(56) References Cited

U.S. PATENT DOCUMENTS

| | | | | |
|---|---|---|---|---|
| 4,247,216 | A * | 1/1981 | Pansini | E04H 4/1609 403/324 |
| 4,325,157 | A * | 4/1982 | Balint | B05C 17/0205 15/230.11 |
| 8,061,751 | B2 * | 11/2011 | Hatcher | B25G 1/04 294/115 |
| 2004/0016385 | A1 | 1/2004 | Wilcox et al. | |
| 2005/0097691 | A1 | 5/2005 | Tsuchiya et al. | |
| 2007/0098487 | A1 | 5/2007 | Kim | |

* cited by examiner

*FIG. 31A*
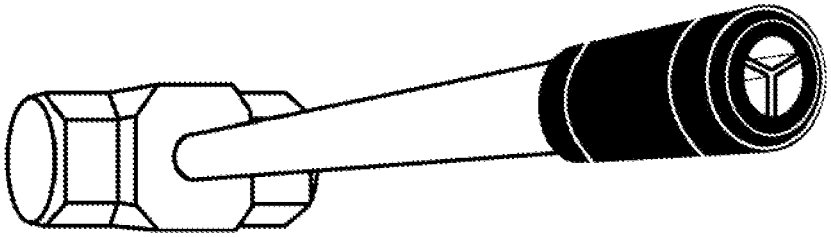
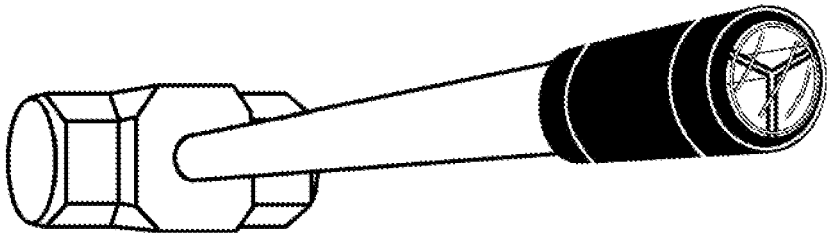
*FIG. 31B*

TELEPOLE APPARATUS AND RELATED METHODS

CROSS-REFERENCE TO RELATED APPLICATIONS

This application claims priority to U.S. Provisional Application Ser. No. 61/538,074, filed Sep. 22, 2011, U.S. patent application Ser. No. 13/624,702 filed Sep. 21, 2012, U.S. patent application Ser. No. 13/844,561 filed Mar. 15, 2013, the disclosures of which are incorporated herein by reference in their entireties. This is a continuation the latter of those applications.

FIELD OF THE INVENTION

This invention relates to devices for cleaning swimming pools and similar things, and more specifically is directed to apparatus and methods involving an improved telescopic pole useful for (among other things) attachment to swimming pool cleaning tools.

BACKGROUND OF THE INVENTION

Many prior art tools are made with extendable handles which serve at least three key functions, among others: they provide a means for a user to grip the tool, they increase extension and reach, and they create leverage. For example, a typical shovel has a pan-shaped head for digging and/or moving dirt. An extendable handle attached to the shovel head allows a user to work in a standing position and keep their hands at a reasonable distance from the work being done (rather than bending/kneeling/etc. down to get close to the work), and it further enables a user to create leverage when prying or scooping with the shovel. An array of hand tools such as hammers, rakes, brushes, scrapers, mops, concrete finishing tools, etc. use extendable handles for similar reasons.

Some of the problems with prior art extendable handles, however, are associated with the failure of the handles to perform adequately during use. It is not uncommon for wooden handles on shovels and other leveraging tools to break under the normal pressure that occurs during use. Sometimes manufacturers use harder woods to reduce such breakage; however, hard woods tend to weigh more than softer woods and consequently, make the tools heavier. Handles made of metal tubes are often used, but these may likewise be heavy or bend when under pressure. It is also common for handles on shovels, rakes, brooms, etc. to be made from synthetic materials such as plastic or fiberglass; such handles likewise may be heavy, lack strength or fail for other reasons.

One such area where extendable handles are very useful, if not essential, is for use with swimming pool cleaning tools (so that a user does not have to get in the water when cleaning a pool or similar water feature, but can reach the water from a standing position on a deck/dry place). A wide variety of tools and processes have been developed for use with swimming pool cleaning tools to clean pools and similar things (fountains, spas—both above and below ground, fish ponds, etc.). Among those devices and methods are devices that are commonly referred to as "telepoles". Other uses for such "telepoles" include window washing tools, paint rolling tools, and concrete spreading/finishing tools.

Specifically within the concrete industry, telescopic poles and/or extending handles are attached to trowels and floats for finishing large/wide/etc. slabs of concrete that could not otherwise be reached without the user having to step in the wet concrete. With extendable/telescopic handles, tubular sections of handle can be attached one after the other to reach 20 to 30 feet, or even more. However, handles of this length may easily sag in the middle between the user and the tool, and manufacturers have attempted to reduce sagging by increasing the diameter and thickening the walls of the tubular sections. In doing so, they use a greater amount of material (typically aluminum within the concrete industry) and, consequently, make the handles heavier and more difficult to work with.

Commonly, telepoles utilize two separate lengths of tubing (configured so that one slides within the other to adjust the overall length of the telepole, and a mechanism or device which "locks" the tubes together at a desired position (so that, while so locked, they do not move/slide with respect to one another). That desired position (in effect, the selected length of the telepole) depends on a number of factors, such as the depth of the pool, the strength of the person using the tool, the particular tool being used, etc. Further, a selected telepole or handle length may be made even longer by adding one or more additional lengths of tubing in a series so that each length contributes to an overall desired length.

Typically, telepole tubing is made from aluminum, fiberglass, or some other light, yet relatively strong material. Generally, in telepoles used for attaching swimming pool cleaning tools, the lower tube (nearest the attached tool) is the "outer" tube, and the upper tube reciprocates within that lower tube. The lower/outer tube typically has a collar-like element at one end and a series of holes near and/or along a portion of the opposite end. The collar means provides a finished end of the tube which receives the inner/upper tube and also serves as a guide to keep the inner/upper tube well-positioned/aligned as it slides within the outer tube. The holes along the opposite end commonly serve several purposes, such as providing attachment means for attaching swimming pool cleaning tools and allowing water to enter and exit the tube, so that the tool will fill with water to some degree during use (making it easier to keep the tool in contact with the bottom of the pool, instead of having it float up off the bottom) and the water can drain from the tube upon removal of the pole/tool from the water.

Typically, a first set of holes is positioned closest to the end of the outer tube (approximately one inch from the end of the pole), consisting of two holes placed on opposite sides of the tube (180 degrees from each other about the tube's circumference). A few inches farther away from the "tool end" of the pole/tube, a second set of two holes commonly is positioned similarly about the tube's circumference, and a third set may be even further from the "tool end" of the pole. The first set of holes nearest the end of the tube are positioned and configured to allow easy attachment and removal of pool cleaning tools such as leaf nets, brushes, vacuum heads, and the like, by using springy plastic "V-clips" having button-like ends that extending outwardly through the first set of holes (typically after also extending from the interior of the tool through corresponding holes in the tool sidewall). Thus, the first set of holes typically act as receiving holes for receiving V-clip buttons, where the V-clip is operably positioned on the attachment end of a pool cleaning tool.

The second set of distally located holes are commonly used for mounting various tools such as lifesaving rescue hooks that require more permanent attachment to the telepole. A third set of holes may be positioned similarly to the first and second sets about the tube's circumference and located even farther from the tube's end than the first or second sets of holes, to enable water to more easily enter into (and/or drain from) the interior of the outer pole/tube.

In many prior art telepoles used for attaching pool cleaning tools, the inner/upper tube is of similar length to the outer tube and has a profile with a smaller circumference than that of the outer tube, in order to permit sliding of the inner tube within the outer tube. The inner/upper tube commonly has a gripping element mounted on one end which provides a gripping surface for a user to grasp the end of the telepole. The gripping element also serves to prevent the inner tube from sliding completely into the outer tube and becoming ungraspable. The opposite end of the inner tube is received by the collar means of the outer/lower tube. Commonly, the end of the inner/upper tube that reciprocates within the outer tube has a cam-like element which serves as an internal pressure locking device to "lock" the inner tube in place within the outer tube.

Essentially, when the inner/upper tube is rotated so that the cam element is aligned with the profile of the inside walls of the outer tube, the inner tube can freely slide within the outer tube (since the cam element does not engage with or apply pressure on the inside walls of the outer tube in this position). However, when the user sufficiently further rotates the inner tube with respect to the outer tube, the inner tube's cam element becomes misaligned with the profile of the inner walls of the outer/lower tube, and the cam element applies a pressure against the inner walls of the outer tube and "locks" the inner tube in place within the outer tube. In this way, the inner tube may be manipulated and positioned (and locked) at a desired position along the length of the outer tube, thereby selectively setting the length of the telepole device.

Other prior art telepole devices utilize an external locking device in which a portion of the collar element on the outer tube acts as a compression fitting. In these devices, an end of the collar element is elongated with male threads and is sometimes capable of expanding and contracting across its diameter. A corresponding female threaded compression ring fits around the male threaded end, and a compression gasket fits at least partially between the male end and the inner tube. The compression ring usually has gripping textures to add grip for a user's hands which may be wet and slippery from pool water. The telepole is locked into a desired position by twisting the compression ring to tighten it to the collar and simultaneously squeezing the gasket against the outside surface of the inner tube. With sufficient pressure, the telepole will generally stay 'locked' in the desired position. Loosening the compression ring reduces pressure on the gasket and allows the inner tube to slide freely again.

Further examples of prior art telepole locking devices include U.S. Pat. No. 5,729,865, which has a sliding locking assembly for retaining the tubes in position relative to one another; and U.S. Patent Application No. 2006/0230581, which has rotatable locking mechanism wherein rotation of a locking segment on the outer tube creates frictional locking engagement with the inner tube.

Other prior art telepoles used to clean swimming pools have both internal and external locking devices, and some even have multiple locks of either type and/or a combination of the two types. For example, some have three tubes, each with a profile of a different circumference such that they fit within each other: an outer tube with an external locking device and tool attachment holes, a middle tube with an external locking device, and an inner tube with an internal locking device and a grip.

The various prior art telepole configurations discussed above have shortcomings. Among other things, the cam element's locking ability may lessen or diminish over time. Repeated use results in wear and tear on the cam and/or the inner walls of the outer tube, causing the contact surfaces of the cam and inner walls to become rough and/or out of round. As a result, a cam may lose its ability to become misaligned with the inner walls of the tube and as a consequence the inner and outer tubes cannot be "locked" in place with respect to each other. In this situation, the cam may also spontaneously align itself with the inner walls of the tube, thus permitting the tubes to readily slide past one another and causing the telepole to collapse/slip when pressure is applied to it during cleaning. The tendency of the cam to spontaneously align with the inner walls may also result in tool failure and even poses the risk of the user falling into the pool if the telepole suddenly collapses while the user is applying pressure to it.

Further, prior art telepoles are prone to bending/becoming deformed during use due to the amount of pressure/weight applied to them by a user. In time, the tubes may no longer be true (aligned with each other). When this happens, the telepole's internal locking devices tend to jam in the areas where the tubes are out of round and/or not straight, resulting in complete failure of the telescopic feature of the pole. In other words, and among other things, poles in this condition may not be extendable or adjustable in length.

Additionally, prior art external locking devices are subject to wear and tear in prior art telepole devices. Over time, the contacting surfaces can wear and/or become smooth and have less friction, which greatly reduces the ability of the compression ring to hold the inner tube in place. In some cases, this allows the inner tube to slide within the outer tube even when the outer ring is tightened to its maximum position. The inner tube may also undesirably rotate when the telepole is in use, thus reducing the user's ability to maneuver the attached cleaning tools as desired. Furthermore, telepoles having only an external locking device have the additional problem of water filling the inner tube during use since there is no cam to plug the end of the inner tube. This can make the telepole very heavy and less maneuverable (as mentioned above, some water inside the tube(s), such as in the lower tube, can be helpful in using the tool, but too much water can be a substantial problem or inconvenience in using the tool). Even further, new prior art telepoles having new compression rings have been known to undesirably permit inner tube rotating and/or sliding within the outer tube.

Attempts to remedy these known issues/problems have led to even more problems. One such attempt increases the tightening force of the compression ring, but it can make the compression ring very difficult to loosen and painful to the user's hands to twist the compression ring either to tighten or loosen it.

The issues described above are common among prior art telepoles used to clean swimming pools and have led to the creation of telepoles with both internal and external locking devices, wherein either device may serve as a backup for the other. The Eliptilock pole made by Skimlite is a further attempt to avert the problems discussed above. Both the inner and outer tubes of an Eliptilock pole have similar elliptical profiles, with the inner tube being slightly smaller than the outer tube; and the inner tube sliding freely when its profile is aligned with the profile of the outer tube. A slight twist from the user causes the inner tube to become wedged within the outer tube and "locked" in place. A twist in the opposite direction releases the inner tube so that its profile is aligned with that of the outer tube and it may freely slide within the outer tube. Over time, however, the areas of contact between the tubes become rough and develop friction, and the inner tube may become jammed within the outer tube. This is especially common when the telepole bends or changes shape due to various pressures placed upon it during use.

Further, "telepoles" or extendable handles used in other applications are not necessarily suitable for use in swimming pools. In window washing, painting, or marine applications, for example, telepole configurations are basically the opposite of those needed for cleaning swimming pools. The grip discussed above is mounted on the outer tube, and the inner tube or tubes extend outward from the user, with the tool mounted on the narrowest/inner tube of the telepole. Such configurations are useful/practical when using a telepole to reach upward or overhead as the highest portions of the telepole are also the lightest. However, swimming pool cleaning generally involves a lateral reach (for above-ground pools) or downward reach (for in-ground pools) which is easier to perform with the heavier part of the telepole extending away from the user. Furthermore, telepoles such as those used for window washing or painting would be especially impractical as the locking devices would be almost constantly under water, hindering the ease and ready adjustment of the telepole's length needed to clean a swimming pool.

Also, the locking devices of telepoles used in other applications are unsuitable for swimming pool cleaning applications. For instance, external locking devices, such as those found on telepoles used for window washing, painting, or marine applications, tend to make pool cleaning difficult as they can easily catch on the edge of a pool or other objects when the telepole is being used, among other things. For example, the Mr. Long Arm Pole (shown in U.S. Pat. No. 5,220,707) has an external locking device with a button that activates a detent mechanism to engage and release the inner tube of the telepole, but is not suitable in swimming pool applications for a number of reasons. Among other things, it is configured the opposite of what is desirable/useful for cleaning swimming pools (i.e., the lighter parts of the pole extending away from the user). Further, the Mr. Long Arm pole is sealed at both ends by a grip on the outer tube end and a threaded adapter on the inner tube end, and therefore is unable to accommodate the commonly-used V-clips of most swimming pool cleaning tools. Moreover, its inner tube is unsealed on the end opposite the threaded adapter (the end that is inserted into the outer tube) and where a series of holes that receive the detent mechanism of the locking device are located along the inner pole's length. These openings in the inner tube would allow water to enter the pole when it is placed in a pool, etc. and make the telepole awkward and cumbersome to maneuver and control during use. Additionally, since the grip is mounted on the end of the outer pole, the detent mechanism would almost always be underwater during use, and adjusting the pole's length would inconveniently require a user to withdraw some or all of the pole from the pool.

Other prior art telepoles have lever-activated compression fittings. Devices having a lever fitting are suitable for certain applications in which a user does not need to adjust his grip/move his hand position from the wider tube to the narrower tube. However, swimming pool cleaning commonly requires a user to repeatedly pass his or her hands back and forth over the locking device (to/from one tube to the other) during cleaning in order to be able to adjust his/her reach, get desired leverage on the tool, etc. Therefore, bulky and/or angular levers that are commonly used on telepoles for other applications may obstruct a user's hand from easily passing back and forth over the lever and thus reduce a user's ability to effectively clean a swimming pool. Furthermore, bumping a lever may cause pain or even injury to a user, especially if his or her hands have been wet for some time or exposed to pool chemicals. Even further, bumping the lever with one's hands, an object, or even against the pool deck may cause the lever to release unintentionally.

Still other problems occur with prior art as the inner tube may easily be overextended, especially among telepoles used for cleaning swimming pools. When overextension occurs, the inner tube can slide completely out of and separate from the outer tube. As a result, the outer tube, along with the attached cleaning tool, can sink to the bottom of a pool and be difficult to retrieve. Reassembling the telepole can be difficult and especially inconvenient if the inner tube has a cam locking device mounted on it since reassembly of the telepole requires that the cam's shoe, the inside tube and outside tube all must be aligned with each other for them to slide back together.

Additional problems arise with grips that fail to remain tightly attached to the end of the inside tube. While grips are generally designed to fit very tightly, they still can be knocked off the end of the inside tube if that tube slides too far or too quickly into the outside tube. When this happens, the inside tube may pass completely out the other end of the outside tube, or at least past the compression ring (on tubes with compression locks). Consequently, a user must reassemble nearly all of the telepole in order to use it again.

OBJECTS AND ADVANTAGES OF THE INVENTION

It is, therefore, an object of my invention to provide an improved telepole device having attachment means for attaching swimming pool cleaning tools. The improved telepole device preferably includes an inner tube which freely slides within an outer tube, and a locking device to temporarily secure said inner tube in a desired position within the outer tube. In a preferred embodiment, both the inner and outer tubes are fabricated from aluminum or a similar material that is both lightweight and durable, and most of the inner tube's length can slide into and extend out from one end of the outer tube. A preferred lightweight design may be at least partially hollow along the length of the tube(s), and durability may be provided by inner/reinforcement wall(s) that extend across the hollow portion(s) of one or both of the tubes. Preferably, one end of the inner tube has a grip mounted thereon which makes that end easy to grasp/grip and also prevents the inner tube from sliding entirely within the outer tube. On the end of the outer tube through which the inner tube slides/extends is a collar element attached thereto and comprised of a locking device having a detent mechanism for "locking" the inner tube in place within the outer tube. Additionally, the inner tube preferably has a distinct profile that matches the opening of the collar element through which it extends. Preferably, the collar's opening and the profile of the inner tube have one or more sides that, due to their relative position with respect to each other, can prevent the inner tube from rotating within the collar. Further, the inner tube preferably has a series of holes along its length which are positioned to receive a pin element of the detent mechanism. The pin element is preferably attached to a spring element and held in place by a housing which is formed into the collar. In its normal "resting" position, the spring pushes the pin towards the inner tube such that, when the pin is aligned with one of the holes in the inner tube, the pin sits in the hole and "locks" the inner tube in position so that it cannot slide/rotate within the outer tube or collar. Also preferably, within an upper portion of the housing above the pin is a button that, when depressed, forces the spring to reverse itself from its normal "resting" position and consequently lifts/releases the pin from its normal position in the housing so that the inner tube may be moved to a new position. Further, the end of the outer tube opposite the collar preferably has attachment holes configured to receive attachable and detachable swimming pool cleaning tools, and an additional set of holes that allow water to drain from the outer tube while a tool is attached.

A further object of my invention is to provide a telepole for cleaning swimming pools, with a detent mechanism as described above, and characteristics that prevent water from entering the inner tube during use so as to preserve the inner tube's buoyancy. In a preferred embodiment, a barrier is formed or otherwise provided inside the inner tube along its length and adjacent to the length-selection holes, to prevent water that may flow through those holes from entering the bulk of the inside portion of the inner tube. In addition, the telepole's buoyancy preferably is further maintained by a plug which is preferably mounted into or otherwise on the end of the inner tube that is opposite the gripping portion. The plug prevents water from entering the inner tube through its end. The end of the outer tube opposite the collar preferably has holes configured to receive attachable and detachable swimming pool cleaning tools.

Another object of my invention is to provide a telepole for cleaning swimming pools, with a compression device to "lock"/temporarily secure the inner tube within the outer tube at a desired position along the inner tube's length. The compression device and the inner tube preferably have corresponding detent-like contact surfaces that engage and disengage each other when the compression device is tightened and loosened, respectively, and enable a user to change the length of the telepole as needed.

Still another object of my invention is to provide a stronger telepole for cleaning swimming pools, including an inner tube that slides within an outer tube and can be "locked"/secured in various places along the length of the inner tube. The inner tube has one or more additional inner/reinforcement walls along its length to add strength and to help keep the inner tube true and round.

Yet another object of my invention is to create a telepole for cleaning swimming pools, including an outer tube having a collar on one end, the collar having a central opening through which an inner tube extends. The collar's opening and the profile of the inner tube have one or more sides keyed to each other such that, due to their shapes, the inner tube cannot rotate within the collar. The collar preferably is configured to include a compression device to lock the inner tube at any given area along its length.

Still another object of my invention is to provide a telepole assembly and related methods for cleaning swimming pools, including an inner tube and an outer tube, and further including a lever-action compression device that is easy on a user's hands. In one of many potential embodiments, the lever is installed in a housing formed within a collar that is mounted on the end of an outer pole. The housing is configured to prevent the lever's edges or corners from protruding in such a way that they might be accidentally bumped by a user's hands or some other object that may disengage the lever. The inner tube preferably has a distinct profile that matches and/or is keyed to the opening of the collar, the compression device, or both, through which it extends. Among various embodiments, the collar's opening, the compression device, or both, and the profile of the inner tube can have one or more flat sides that, due to their shapes, prevent the inner tube from rotating within the collar. The inner tube preferably has a plug in its end furthest from the grip, said plug preserving buoyancy by preventing water from entering the inner tube.

Yet another object of my invention is to provide a telepole for cleaning swimming pools, including an inner tube and an outer tube, in which the outer tube is made with a profile that is not perfectly round, and the inner tube has a locking device mounted into it. The locking device is activated when a user twists the inner tube and causes the locking device to wedge itself against the uneven inner walls of the outer tube; said locking device being deactivated by a twist in the reverse direction. Other of the many embodiments of the invention would include reversing the parts just described, so that the inner tube is not perfectly round so that twisting of the inner tube with respect to the outer tube will result in a temporary fixed engagement of the two tubes with each other.

Still another of the many embodiments of the invention would include an inside tube and an outside tube having profiles similar to each other, with neither profile being perfectly round. The inside tube further has one or more additional/inner reinforcement walls along its length to add strength and help the inside tube retain its shape and remain true and straight. The inside tube slides within the outside tube and can be extended out of the outside tube to give the telepole additional length. A user can 'lock' the telepole at an overall desired length by rotating the inside tube within the outside tube until the sides of both tubes, being slightly out of round, wedge themselves against each other. Similarly, a user can 'unlock' the telepole by rotating the inside tube in the reverse direction, and subsequently readjust the overall length of the telepole. A plug may further be added to the inside tube to prevent it from filling with water during use in a pool or similar water feature.

BRIEF DESCRIPTION OF THE DRAWINGS

FIG. 31A is a perspective view of another of the many embodiments of the invention, illustrating a hammer (head to the left side of the figure) having an open end on the grip (the right-most portion of the figure), to reveal the internal reinforcement walls of the handle element (for customers/users to see).

FIG. 31B is similar to FIG. 31A, but has a clear/transparent covered right-most end, to allow customers/users to see reinforcement walls while also protecting the user's hands from abrasion or other discomforts that might be caused by contact with an open-ended embodiment such as shown in FIG. 31A.

DETAILED DESCRIPTION

Figure 1:
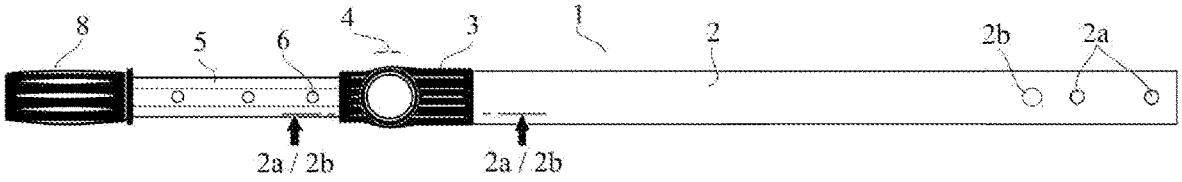
FIG. 1 is a plan view of a preferred embodiment of a telepole constructed in accordance with the teachings of the invention.

Embodiments of the present invention will now be described with references to the accompanying figures, wherein like reference numerals refer to like elements throughout. The terminology used in the description presented herein is not intended to be interpreted in any limited or restrictive manner, simply because it is being utilized in conjunction with a detailed description of certain embodiments of the invention. Furthermore, various embodiments of the invention (whether or not specifically described herein) may include novel features, no single one of which is solely responsible for its desirable attributes or which is essential to practicing the invention herein described.

Although the examples of the many various methods of the invention are described herein with steps occurring in a certain order, the specific order of the steps, or any continuation or interruption between steps, is not necessarily intended to be required for any given method of practicing the invention.

Persons of ordinary skill in the art will understand that the apparatus of the invention and various of its many methods can be practiced using any of a wide variety of suitable processes and materials. By way of example and not by way of limitation, certain embodiments of the apparatus can be manufactured via processes using one or more steps of routing, drilling, turning, injection molding, extruding, thermo-forming, casting, and many other existing and new processes that may come into being. Materials are not limited in any way and could extend from metals to plastics, to resins of all types. A preferred material is lightweight, non-corrosive and will hold up to the exposure anticipated in its eventual usage (including by way of example, chlorine water, salt water, marine environments, UV exposure, etc.). A preferred method of manufacture is by injection molding and extruding various components of the embodiments, and by machining others and/or buying them from commercially-available sources.

Referring now to the drawings, and particularly to FIGS. 1, 2*a*, 2*b*, 3*b*, 5*a*, and 5*b*, a preferred embodiment of a telepole device 1 used for cleaning swimming pools is shown, including an outer/lower tube 2 having a collar element 3 with a detent locking device 4 mounted thereon, and an inner/upper tube 5 that slides through an opening in the collar element and within the outer tube. Preferably, the inner/upper tube has a profile with a smaller circumference than that of the opening of the collar element and the outer/lower tube so that it may readily slide within/through those elements in order to provide a telepole device having an adjustable length. Further, the inner/upper tube has a gripping portion 8 that may be attached with rivets, screws or other temporary or (semi-)permanent attachment devices. The gripping portion provides an area for a user to grip/grasp the telepole device and also prevents the inner tube from sliding entirely within the outer tube as the circumference of the gripping portion is larger than that of the collar element and/or outer/lower tube. Further, attachment devices (rivets, screws, or the like) can prevent the gripping portion from being "bumped" off the end of the tube when the inner tube slides into the outer tube, and they also make removing and/or replacing a worn handle possible.

Preferably, the outer/lower tube has a series of openings/holes 2*a* for receiving attachment means of cleaning tools, and has at least one drain hole 2*b* for allowing water trapped in the outer/lower tube to drain out. As will be further described herein, some of the many alternative embodiments of the invention can be practiced without all of these elements. Moreover, persons of ordinary skill in the art will understand that the elements described herein may even be provided in other embodiments in a wide variety of other forms depending on the desired use/application of the device.

As indicated, the present invention preferably includes means to adjust the length of the pole within the assembly. Persons of ordinary skill in the art will understand that this can be accomplished in a wide variety of ways, using various apparatus and methods. In a preferred embodiment of the present invention, the inner/upper tube has a series of openings/holes 6 along its length that are configured to receive a detent pin element 7 located in a housing 10 of the collar element in order to "lock"/temporarily secure the inner/upper tube in a desired position within the outer/lower tube. The detent pin element is affixed to a spring element 9 that, when in its normal "relaxed" position, allows the pin element to sit/rest simultaneously in a hole 10*a* through the housing of the collar element and one of the holes of the series 6 in the inner tube, thus locking the inner/upper tube into a desired position within the outer/lower tube. In addition, a button element 11 is mounted within the housing above the detent pin and is held in place by tab elements 12. When the button element is depressed by a user, the spring is pressed against an uneven surface 13 in the housing and forced into an "unrelaxed" position which in turn causes the pin element to be lifted out of the inner tube's hole 6, thus releasing the inner tube so that it can be moved into a new position within the outer tube. Releasing the button allows the spring to revert to its normal, relaxed position and enables the detent pin to reenter a hole 6 in the inner tube so that the inner tube may be secured in another desired position within the outer tube.

Further in a preferred embodiment, a saddle bushing 5*a* is provided between the outer wall 15 of the of the inner tube and the inner wall 16 of the outer tube. The saddle bushing element has a post element 14 that fits into a designated hole 6*a* for receiving the post element in the inner tube in order to guide the inner tube into proper alignment with the outer tube (i.e., so that the detent pins may be readily aligned with the detent holes) and to prevent the inner tube from sliding past the housing and separating from the outer tube. Further, a plug 21 at the end of the inner tube opposite the end with the gripping element 8 preferably prevents water from entering through the inner tube's end.

Telepoles which are used in swimming pool (or similar) cleaning applications are repeatedly submerged in water of varying depths. Accordingly, a telepole capable of reaching below the water's surface (at times a significant amount below) is desirable, especially when cleaning deep areas of a pool, during long reaches, or both. It is a well known issue that water may easily enter the outer tubes of prior art extendible poles, through an attachment hole or other opening, and it may likewise enter the inner tube of the pole assembly. It is very undesirable, however, for water to enter the inner tube because, for example, it adds a significant amount of weight to the telepole device making it more difficult to maneuver the pole/assembly and taking longer to drain the device.

Accordingly, in a preferred embodiment of the present invention, the inner tube is configured such that water is prevented/stopped from entering some (and preferably most or even all) of the hollow portion of the inner tube. Persons of ordinary skill in the art will appreciate that there are numerous potential inner tube configurations which may provide a water tight seal to the telepole device, and that depending on the intended use of the device, any of these potential configurations (or combinations of them) may be desirable for use with the present invention. Moreover, any existing non-water tight inner tube of an existing device may be retrofitted with an inner tube that is configured to prevent water from leaking in.

Figure 3:
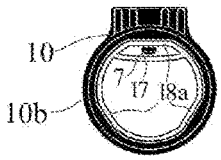
FIG. 3 is a sectional view taken along Line 3-3 of FIG. 2*a;*
Figure 3A:
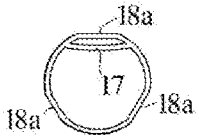
FIG. 3*a* is a profile view of the inner tube of the preferred embodiment.
Figure 3B:
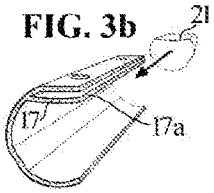
FIG. 3*b* is a dimensional view of a portion of the section taken along Line 2*a*/2*b*-2*a*/2*b* of FIG. 1.
Figure 3C:
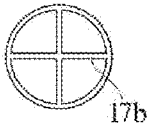
FIG. 3*c* is an alternative embodiment of FIG. 3*a;*
Figure 3D:
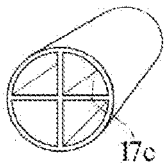
FIG. 3*d* is a dimensional view of FIG. 3*c;*
Figure 4A:
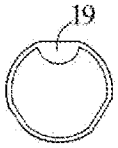
FIG. 4*a* is an alternative embodiment of FIG. 3*a;*
Figure 4B:
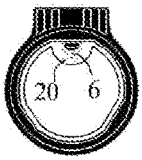
FIG. 4*b* is an alternative embodiment of FIG. 3.
Figure 5A:
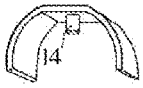
FIG. 5*a* is a dimensional view of a saddle bushing used in the preferred embodiment.
Figure 5B:
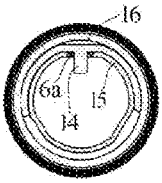
FIG. 5*b* is a sectional view taken along Line 5*b*-5*b* of FIG. 2*a;*
Figure 6A:
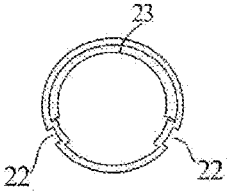
FIG. 6*a* is an alternative embodiment of FIG. 3*a;*
Figure 6B:
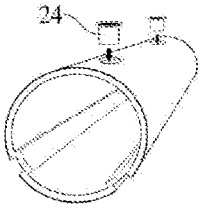
FIG. 6*b* is an alternative embodiment of FIG. 3*b;*
Figure 7:
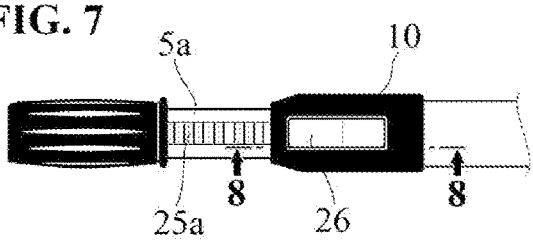
FIG. 7 is a partial view of an alternative embodiment of FIG. 1.
Figure 8:
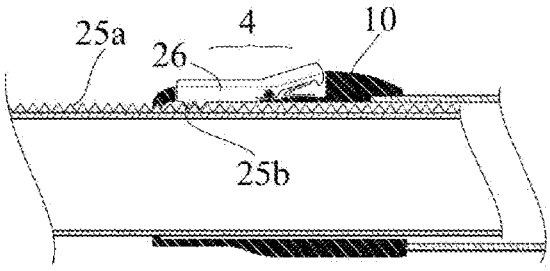
FIG. 8 is a sectional view taken along Line 8-8 of FIG. 7.
Figure 10:
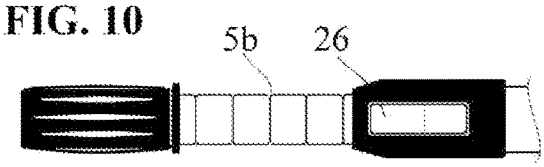
FIG. 10 is an alternative embodiment of FIG. 7.
Figure 11:
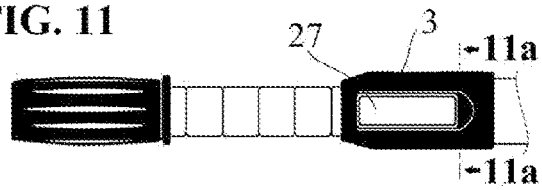
FIG. 11 is an alternative embodiment of FIG. 7.
Figure 9:
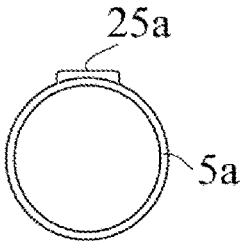
FIG. 9 is a profile view of the inner tube of FIG. 8.
Figure 11A:
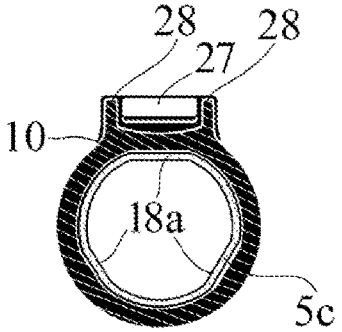
FIG. 11*a* is a sectional view taken along Line 11*a*-11*a* of FIG. 11.

FIG. 3*a* shows an example of a preferred inner tube which is configured to provide a watertight seal. The inner tube has a barrier 17 which prevents water from entering the inner tube through the series of detent holes 6 along the length of the inner tube. Preferably, the barrier runs the length 17*a* of the inner tube, and is configured to allow the detent pin 7 enough space to sit within the hole 10*a* of the housing 10 and a detent hole 6 in the inner tube when the spring 9 is in its normal, relaxed position. In such embodiments, almost the entire interior volume of the inner tube is watertight; the only portion "open" to water is the small sliver of space between the tube outer wall and the barrier 17, into which the pin protrudes when engaged. Although a watertight telepole device is desirable for many reasons in pool/water cleaning applications, persons of ordinary skill in the art will appreciate that the numerous benefits provided by this invention may still be realized even in non-watertight embodiments.

Further in a preferred embodiment, the inner tube has a distinct profile/shape that corresponds or is keyed to the profile/shape of the opening 10*b* of the collar element through which it extends. Among other things, this keyed relationship can prevent the undesirable rotation of the inner/upper tube within the collar element and outer/lower tube, and thereby allow the user to have more certain control over the assembly during its use in cleaning or other activity. In this preferred embodiment, the collar's opening and the profile of the inner tube are similarly out-of-round having one or more corresponding "sides" 18*a* that prevent the inner tube from rotating within the collar. This ensures that the pin 7 will always be aligned with the series of detent holes 6 along the length of the inner tube, and it enables a user to maneuver attached tools more effectively during cleaning.

In a preferred embodiment of the present invention, an inner/upper tube with a profile that includes one or more additional inner walls across its diameter is provided in order to give the inner/upper tube added strength along its length. This improved inner/upper tube with additional inner strengthening walls may be used with existing telepoles (for swimming pools or other uses) in a retrofit embodiment. In this embodiment, the existing inner/upper tube may be replaced/retrofitted with an improved inner/upper tube with additional inner strengthening walls or means. In this embodiment, the existing and improved inner/upper tubes have the same outer profiles along their lengths such that they both readily slide through the collar and outer/lower tube, and can easily be replaced with one another.

More broadly, persons of ordinary skill in the art will understand that the various components of certain embodiments of the invention can be provided in a modular and interchangeable form, facilitating economic manufacture/assembly/distribution of the devices, easy replacement of worn or damaged parts, exchange of longer pole/tube elements for shorter ones (and vice versa), and other benefits.

Persons of ordinary skill in the art will appreciate that a variety of inner tube profiles/shapes may be provided in accordance with the present invention. For example, among the many benefits provided by varying profiles/shapes/configurations, the inner tube(s) of the present invention may be configured to reduce bending of the inner tube, prevent water from entering the inner tube through the detent holes, keep the inner tube from rotating within the outer tube, and/or facilitate a plug with a locking device having a shape that corresponds to a tube's profile.

Figure 15A:
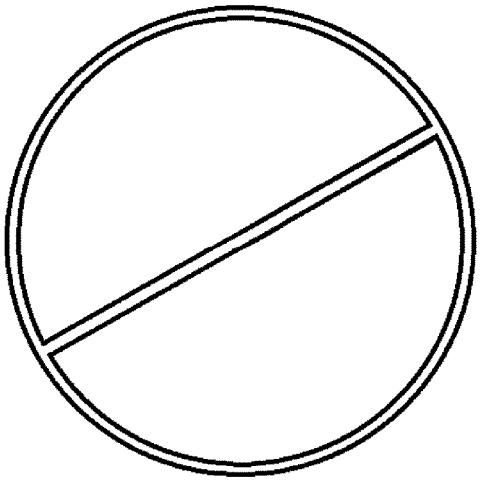
FIG. 15*a* is a profile view of a tubular handle having an inner/reinforcement wall, in accordance with an embodiment of the present invention.
Figure 15B:
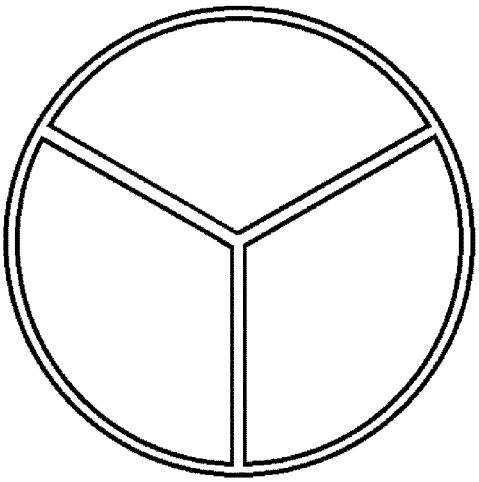
FIG. 15*b* is an alternative embodiment of FIG. 15*a;*
Figure 22:
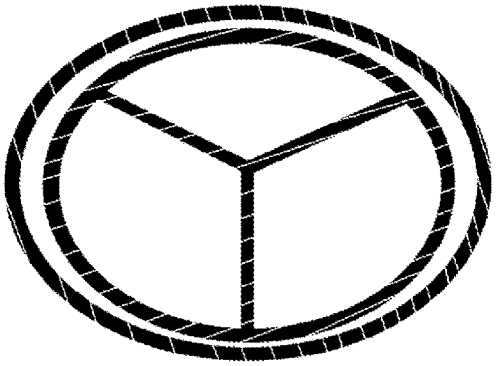
FIG. 22 is a profile view of a tubular handle having an elliptical profile and having inner/reinforcement walls, in accordance with an embodiment of the present invention.

In a preferred embodiment of the present invention, additional wall(s) 17*b* may be provided along the length 17*c* of the inner tube to increase its strength/resistance to bending, denting, etc. Persons of ordinary skill in the art will appreciate that those additional wall(s) may be configured in many possible ways while still providing additional strength along the length of the tube. For example, FIGS. 15*a* and 15*b* show two possible configurations of inner/reinforcement walls provided within a tubular handle. In FIG. 15*a*, a single reinforcement wall extends along a hollow portion of the inner tube from one side of the tube to another. In FIG. 15*b*, additional walls are provided which cross at least a portion of the tube's inner profile and intersect with each other at approximately the center of the inner portion of the tube. Persons of ordinary skill will understand that these are just examples of some of the possible configurations of reinforcement wall(s) within an inner tube, and that other possible configurations and numbers of walls which may be provided are virtually unlimited. As an example, FIG. 22 shows inner/reinforcement walls provided within a telepole having an elliptical profile. In such an embodiment, both the outer/lower tube and inner/upper tube of the telepole/tube have elliptical profiles, and inner/reinforcement walls are provided along the length of the inner tube.

In addition to or within another embodiment, a thickened wall portion 19 along the length of an inner tube may be provided with detent holes 6 drilled partially into that thickened portion to accommodate detent pins, and the remaining portion 20 providing a barrier that prevents water from entering the inner tube.

Figure 23A:
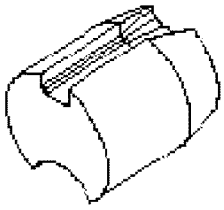
FIGS. 23*a* and 23*b* show buoyancy plug means for maintaining a tube's buoyancy, in accordance with an embodiment of the present invention.
Figure 23B:
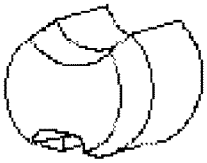
Figure 24A:
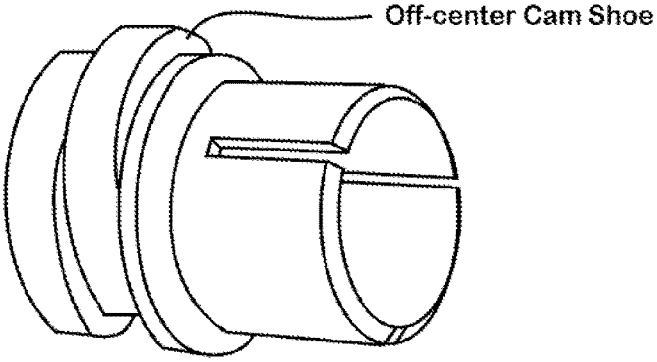
FIGS. 24*a* and 24*b* show plug means being adapted to also function as interior locking devices, in accordance with an embodiment of the present invention.
Figure 24B:
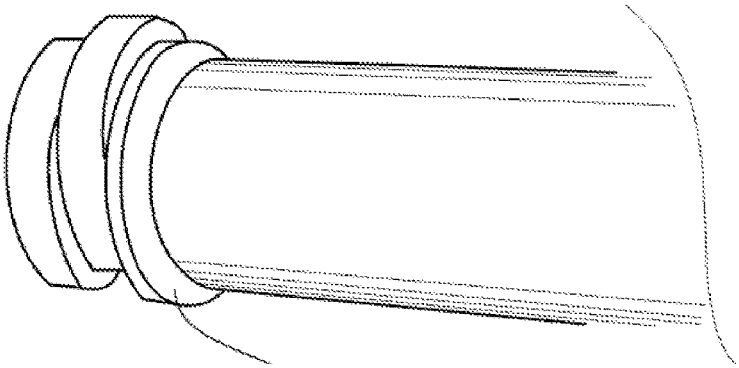
Figure 24C:
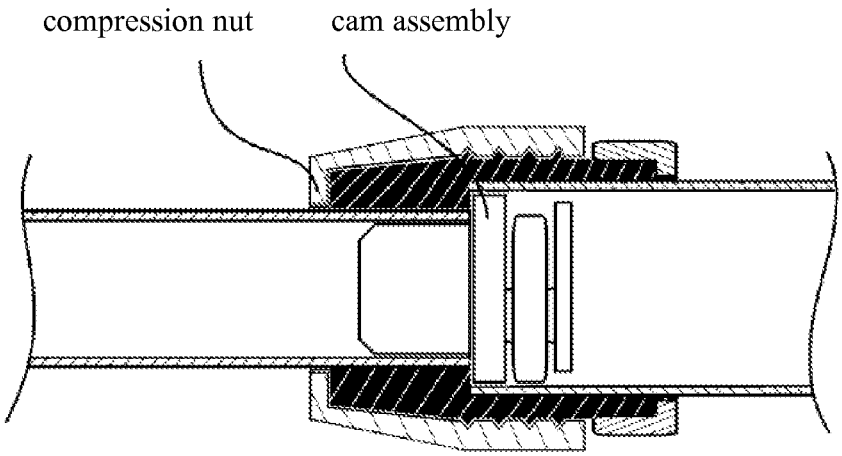
FIG. 24*c* shows a plug means similar to the one shown in FIGS. 24*a* and 24*b*, wherein the plug is operatively assembled within a telepole device according to an embodiment of the invention.

In embodiments having thickened wall portions and/or reinforcement walls, buoyancy plug(s) may be provided within an inner/upper tube to maintain and/or increase the buoyancy of the tube. FIGS. 23*a* and 23*b* show possible buoyancy plug embodiments, wherein the plugs are configured to accommodate reinforcement wall(s) and/or thickened wall portion(s) within an inner/upper tube. In addition and as shown in FIGS. 24*a-c*, such plugs can be further adapted to function as interior locking devices having spreaders or an eccentric cam. In such embodiments, a cam assembly on the plug is configured as a "stop" to keep the inner/upper tube assembled within the outer/lower tube. As shown in the figures, a portion of the plug and/or cam assembly is wider than the opening on the compression nut to prevent the inner/upper tube from sliding out of the outer/lower tube when the telepole is fully extended. In a telepole device that does not have a compression locking device, a ridge on the collar of the device (similar to the compression nut shown in the drawings) may function to prevent the inner and outer tubes from separating.

In another alternative embodiment of the present invention, the inner tube may be provided with notches 22 about its circumference or other/similar sides that correspond to protrusions/tabs in the collar element in order to prevent the inner tube from excessively or undesirably rotating within the outer tube during use. Alternatively or concurrently, further barriers/parts such as a sleeve element 23 or cup element 24 may be permanently or temporarily provided in key areas to provide a water tight seal to the inner tube.

Furthermore in an alternative embodiment of the present invention, an outer tube having a profile that is not perfectly round may be provided along with an inner tube having a locking device mounted thereon or integral therewith. In this embodiment, the locking device is activated when a user twists the inner tube and causes the locking device to wedge itself against the uneven inner walls of the outer tube. The locking device is deactivated by a twist in the reverse direction.

Figure 2A:
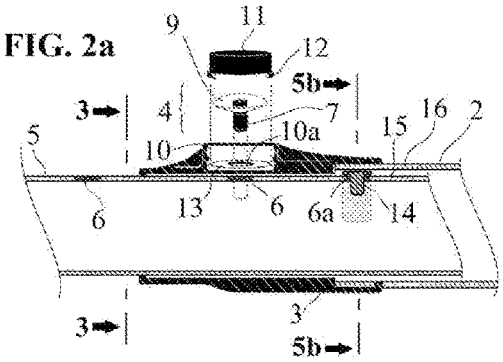
FIGS. 2*a* and 2*b* are sectional views taken along Line 2*a*/2*b*-2*a*/2*b* of FIG. 1, showing an exploded view of the detent mechanism of the preferred embodiment.
Figure 2B:
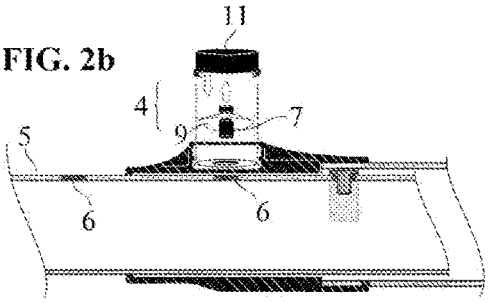
Figure 2C:
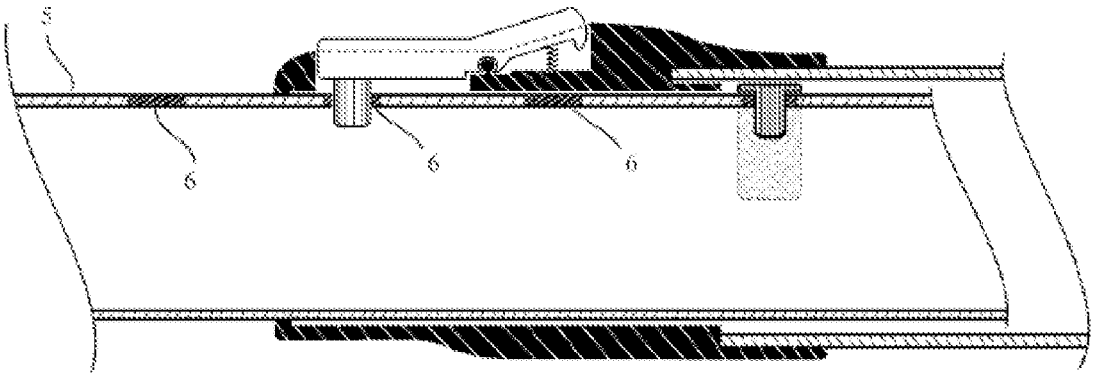
FIG. 2*c* is an alternative embodiment of the detent mechanism shown in FIGS. 2*a* and 2*b;*

Persons of ordinary skill in the art will appreciate that the detent mechanism of the present invention has many potential embodiments, all of which provide the benefits realized by the present invention. Referring now to FIGS. 7, 8, 9, 10, 11, and 11*a*, in one potential embodiment, the inner tube 5*a* may have a row of teeth 25*a* or other detent components along some or all of its length, a collar with a housing 10 formed into it, and a detent mechanism 4 including a device such as a rocking lever 26 with corresponding teeth 25*b* or some other element corresponding to the inner tube's detent component. Yet another preferred way of practicing the detent mechanism of the present invention is a spring-loaded lever detent means. As shown in FIG. 2*c*, unlike the rocking lever detent means of FIG. 8, the spring-loaded lever mechanism has a detent pin that fits into holes along the inner tube.

Persons of ordinary skill in the art will also appreciate that the detent components of the inner tube may be configured, formed and/or attached to the inner tube in many ways. For example, a detent component 25*a* may be provided on an external portion of an inner tube 5*a* having a round profile. The external component may be integrally formed with the inner tube or permanently or temporarily attached to the inner tube during assembly. This external component may provide "sides" on the inner tube that correspond to indentations/protrusions/tabs on the collar in order to prevent unwanted/excessive rotation of the inner tube within the outer tube.

Figure 25:
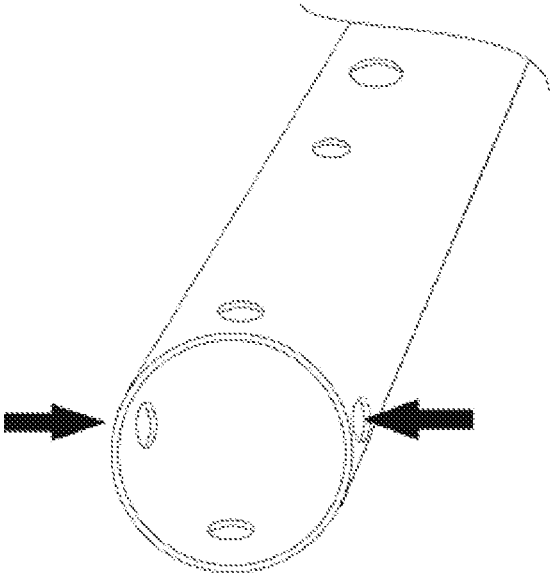
FIG. 25 shows a telepole end portion having additional holes to enable tools with various V-clip positions to be oriented on the telepole with respect to the position of the lever/button of the detent means.

With the addition of a lever/button detent means, a "face" is created on the outside of the telepole (rather than the telepole simply being round with no identifiable sides/front/back). Therefore, additional attachment holes are needed to accommodate tools such as brushes having V-Clips which are mounted to the telepole in a horizontal position (with respect to the direction the tool moves when it is used to clean a pool, for example). Other tools such as leaf nets have V-Clips mounted in a vertical position in relation to the way the net moves through the water. As shown in FIG. 25, adding a second set of attachment holes (90 degrees away from the first set), the lever or button of the detent means can be oriented to the tool according to the preference of the user. The addition of such holes may also reduce wear and tear on the end of a telepole. Since cleaning tools are almost constantly exposed to pressure during use, a plurality of attachment holes may distribute that pressure to more than one area around the telepole's end. Thus, a second set of such attachment holes may be added to telepoles that have no lever/button detent means or "face" and are round with no identifiable sides/front/back.

Figure 12A:
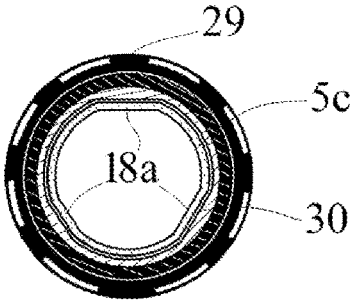
FIG. 12*a* is a sectional view taken along Line 12*a*-12*a* of FIG. 12.
Figure 12:
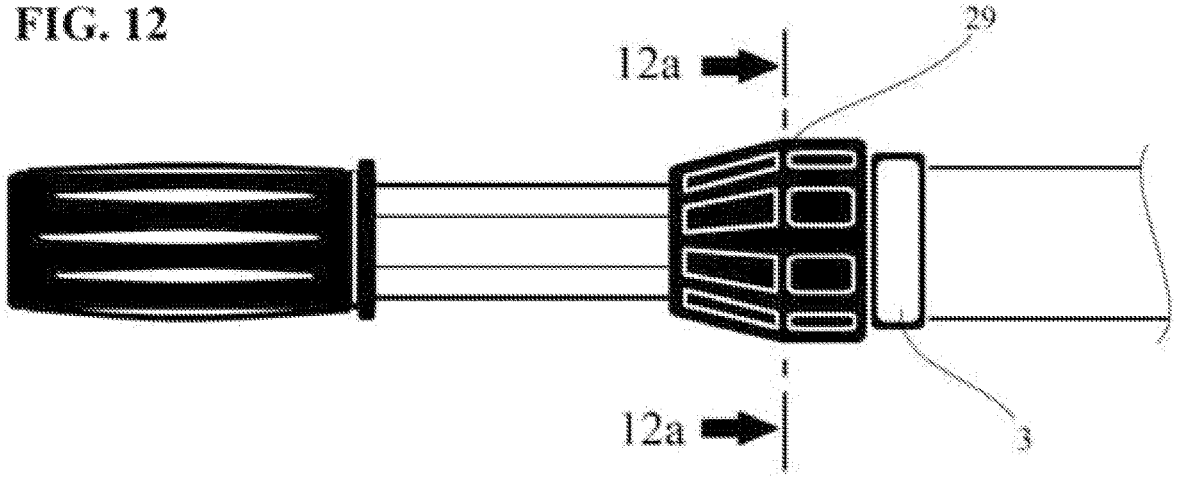
FIG. 12 is an alternative embodiment of FIG. 11.

In an alternative embodiment, the inner tube may be formed with inclusions 5*b*, ribs or other detent components which correspond to complementary detent elements provided in a detent mechanism located adjacent to or within the outer pole's collar element, such as a rocking lever 26 or an end-hinged lever 27. In addition, a compression device such as the end-hinged lever shown in FIG. 11*a* or threaded compression ring 29 shown in FIG. 12 may further be used with a collar element 3 or some other compression device element. For example, a compression gasket 30 having an opening that corresponds to the profile of an inner tube 5*c* may be provided. In this embodiment, the gasket opening and corresponding profile of the inner tube are configured with one or more corresponding "sides" 18*a* that prevent the inner tube from rotating within the collar.

Figure 12B:
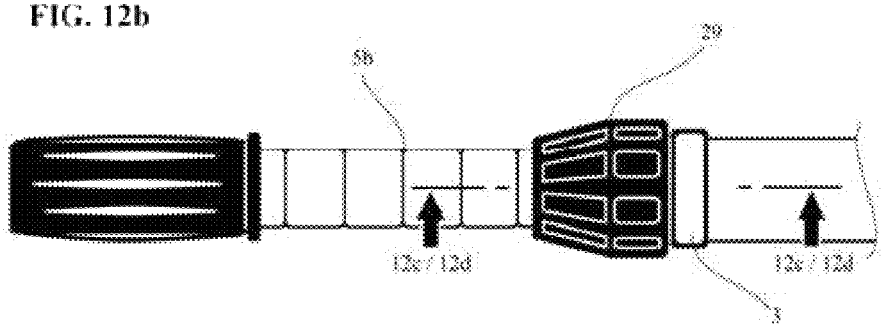
FIG. 12*b* is an alternative embodiment of FIG. 12.
Figure 12C:
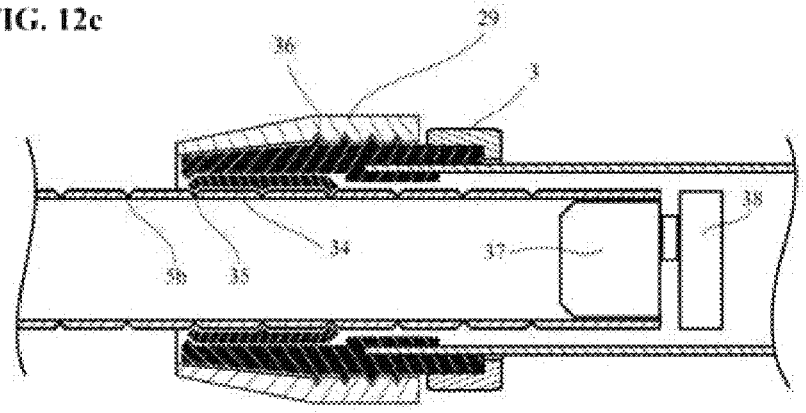
FIG. 12*c* is a sectional view taken along line 12*c*/12*d*-12*c*/12*d* of FIG. 12*b;*
Figure 12D:
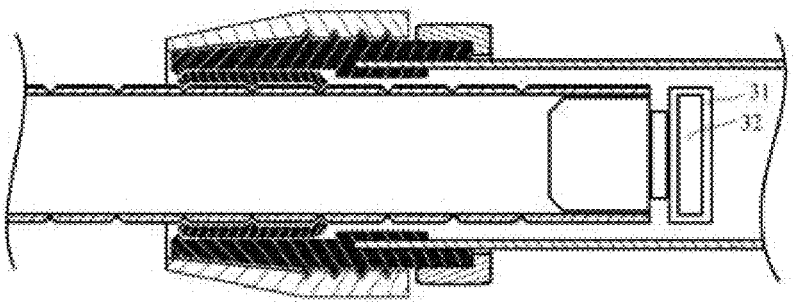
FIG. 12*d* is a sectional view taken along line 12*c*/12*d*-12*c*/12*d* of FIG. 12*b;*
Figure 13A:
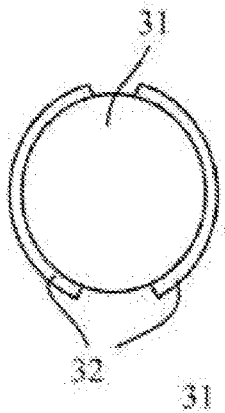
FIGS. 13*a* and 13*b* are front views of an inner tube's internal locking device.
Figure 13B:
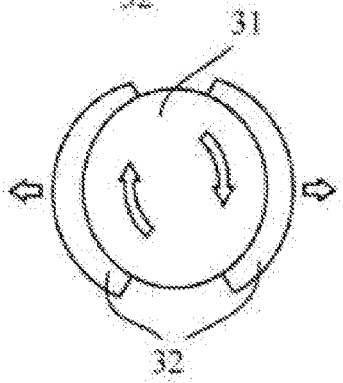
Figure 13C:
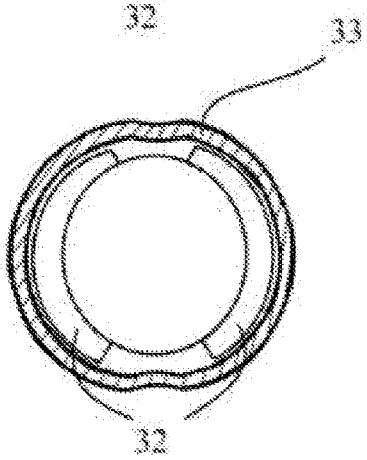
FIG. 13*c* is a front view of FIGS. 13*a* and 13*b*, within an outer/lower tube.

Additionally, FIGS. 12*b*, 12*c*, and 12*d* show a telepole device in accordance with the present invention having an outer tube including a collar element 3 comprised of a threaded portion 36 and a portion for receiving a compression gasket 34. Teeth, ridges, or other similar detent means 35 are formed into the compression gasket which matingly engage with inclusions, ribs or other similar detent elements 5*b* along the outer walls of the inner tube. Tightening the compression ring causes the teeth of the compression gasket to engage with the inner tube's detent elements and in turn prevents the inner tube from sliding within the outer tube. Conversely, loosening the compression ring disengages the teeth and detent elements, and permits a user to adjust the telepole's length by sliding the inner tube within the outer tube. In a another embodiment, the compression gasket may be provided with ribs or similar detent means which correspond to detent features along the outer walls of the inner tube, and which hold the inner tube in place along the length of the outer tube but allow the inner tube to rotate within the outer tube. In yet another embodiment, the inner/upper tube and the compression gasket and/or collar's opening may each have one or more corresponding sides that prevent rotation of the inner tube within the outer tube.

Further, a plug or internal locking device 37 may be fitted into the end of the inner tube to further prevent the inner tube from slipping or rotating within the outer tube, and may even keep water from entering the inner tube. In certain embodiments, the internal locking device may include an off-center cam 38 or other spreading device 31 having moving parts 32 that can be wedged against the inner walls of the outer tube in order to lock the inner tube in a desired position along the length of the outer tube. Even further, the inner tube may have one or more sides that are keyed to correspond with one or more sides of the compression device and/or its components to facilitate "locking" the inner tube in place with respect to the outer tube and preventing any undesired or excessive rotation of the inner tube within the outer tube.

Figure 14:
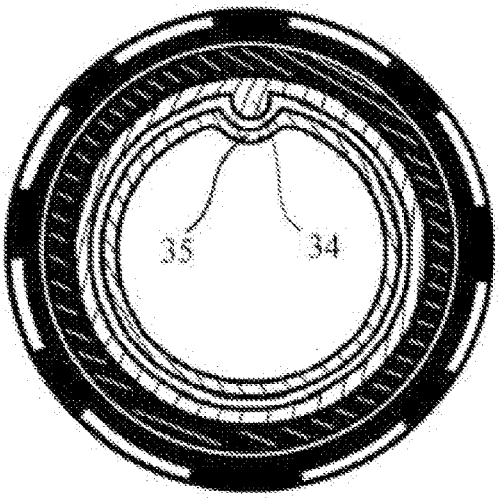
FIG. 14 is an alternative view of FIG. 12*a;*

Moreover, a telepole with any suitable compression device for "locking" the inner tube in a given position within the outer tube may further include an outer tube which is configured to prevent the inner tube from rotating within the outer tube. In one potential embodiment, as shown in FIG. 14, an outer tube may be provided with an inward/interior-facing protrusion 34 within its profile, and an inner tube may correspondingly have an indentation 35 within its profile. The indentation in the inner tube may be capable of receiving the outer tube's protrusion for the purpose of preventing the inner tube from rotating within the outer tube. Since such a configuration may make it difficult or impossible for the outer tube to receive standard cleaning tool attachment means, an adapter may be mounted on the outer tube's end to enable standard tools with V-clips to be attached to the present telepole device.

In some of the many alternative embodiments of the present invention, any levers and/or buttons, etc. may be partially or entirely recessed into a housing 10 that has sides 28 to protect the levers and/or buttons from being bumped by a user's hands or any other object or surface that may cause damage to or accidental release of the lever or detent mechanism.

In further alternative embodiments, a telepole for cleaning swimming pools in accordance with the present invention may include an outer tube whose profile is not uniformly round/circular along its length, and an inner tube having a cam or other similar spreading device 31. This configuration increases the ability of the inner tube to be "locked" in place within the outer tube. By twisting and rotating the inner tube within the outer tube, a user can misalign the cam or activate the spreading device so that the sides of its moving parts 32 engage themselves with the out-of-round inner walls 33 of the outer tube and lock the inner tube in a desired position. A reverse action disengages the cam or spreading device and unlocks the inner tube and permits readjustment of the telepole's length.

Persons of ordinary skill in the art will appreciate that the "locking" mechanisms described herein may be combined with other locking mechanisms described herein or others which are known in the art in order to provide a device that achieves the objects presented herein. On the other hand, any locking mechanism may stand alone to effectively achieve those objectives.

Figure 16A:
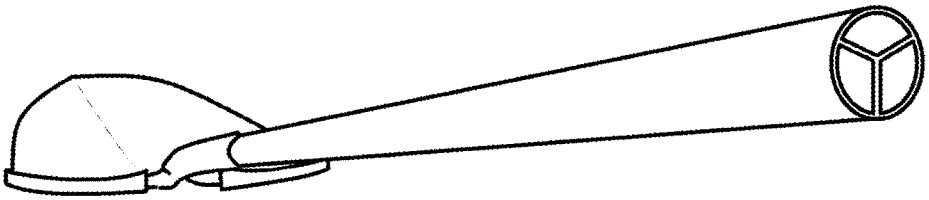
FIG. 16*a* is an elevation view of a tubular handle having inner/reinforcement walls attached to a tool, in accordance with an embodiment of the present invention.
Figure 16B:
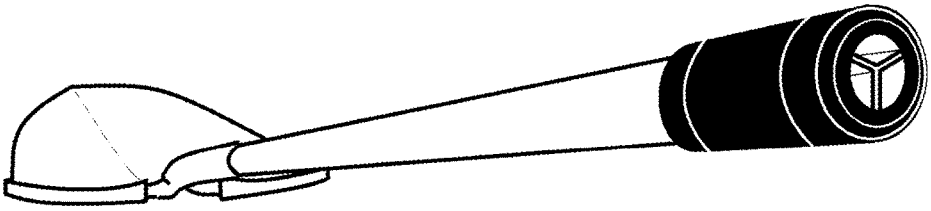
FIG. 16*b* is similar to FIG. 16*a*, having a gripping portion on the end of the tubular handle.
Figure 17:
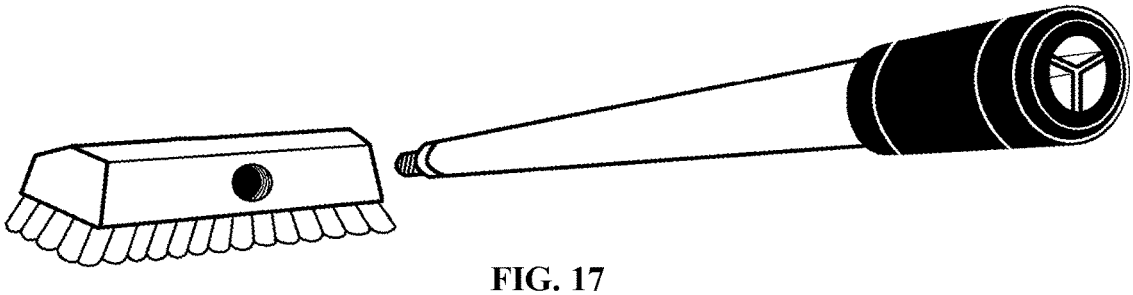
FIG. 17 shows a tubular handle similar to that shown in FIG. 16*b* being detached from a tool.

The present invention further provides means for attaching, detaching and re-attaching a variety of tools to the tubular handle of the present invention. As shown in FIGS. 16*a/b* and 17, a tubular handle of the type described herein having inner/reinforcement walls along its length may be attached to any type of tool, depending on the need of the user. If/when it is desired to remove/detach that tool from the tubular handle, the tool may be detached from the handle, as shown in FIG. 17.

In an embodiment of the present invention, that attachment means may be provided as a "quick-release" device for easy attachment and detachment of the tool and the tubular handle. As shown in FIGS. 18*a-e*, a quick-release device may be provided on the tool, handle, or both to enable ready attachment and detachment of the parts from each other. As shown in the drawings, a preferred quick-release device for use with the present invention is a spring-loaded button mechanism, however, persons of ordinary skill will appreciate that this is only an example of the many possible devices which may be used. For example, a quick-release device in accordance with the present invention may include a threaded end that can be twisted to either tighten or loosen the (tool) attachment, may be an interlocking device, and/or utilize V-clips, etc. The convenience provided by quick-releasing tools/handles is especially beneficial in applications of working with and finishing concrete wherein tools such as a bull float, trowel, rolling tamper, seamer, and various other tools or adapters are commonly used in conjunction with an extendable handle.

Figure 18A:
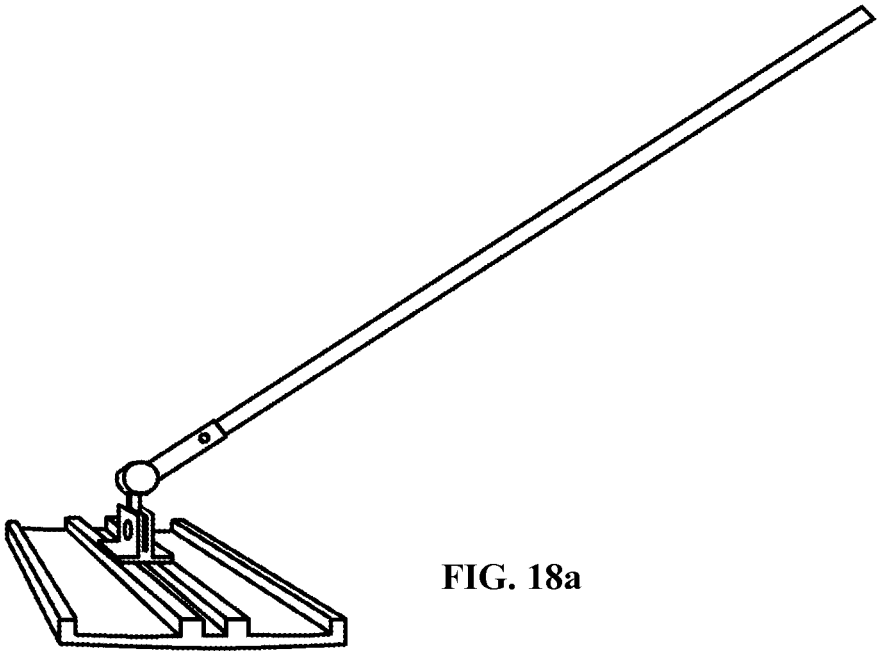
FIG. 18*a* is an elevation view showing a quick-release device being used with a tool and handle in accordance with an embodiment of the present invention.
Figure 18B:
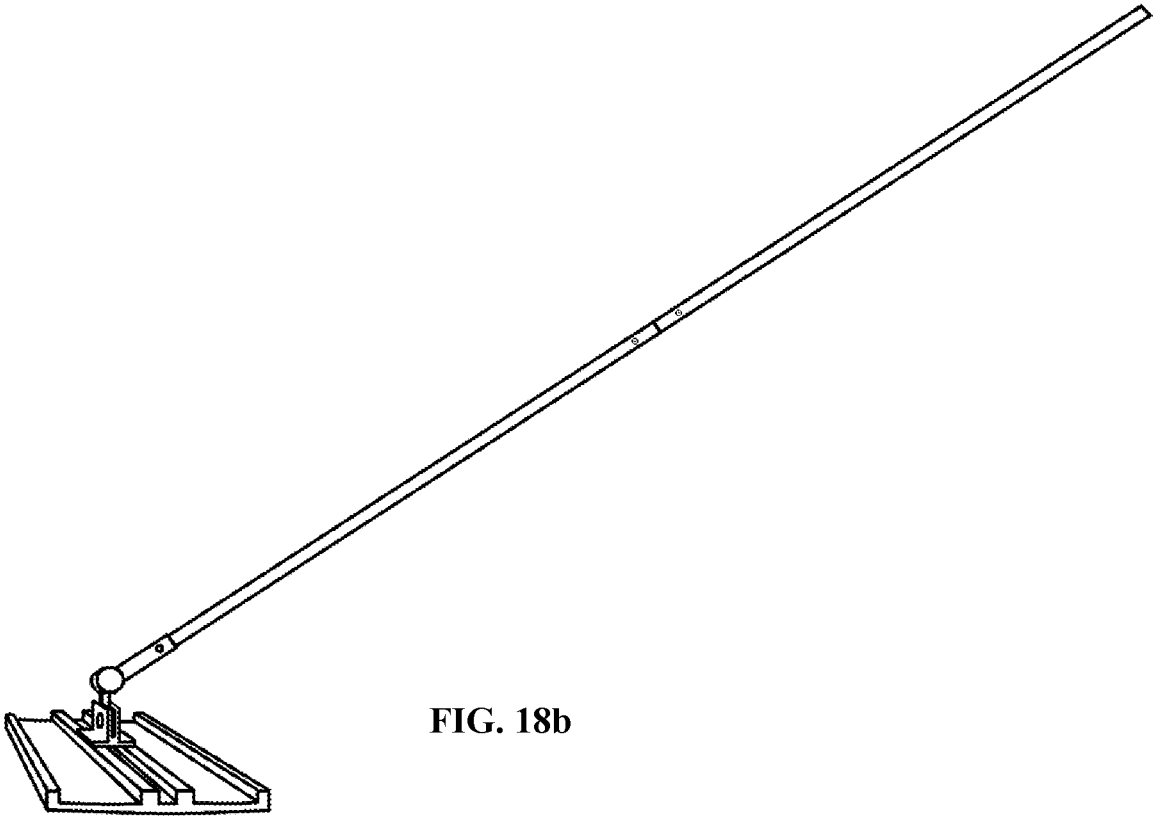
FIG. 18*b* is similar to FIG. 18*a*, wherein the tubular handle is attached to another similar tubular handle to increase the overall length of the handle configuration of the device.
Figure 18C:
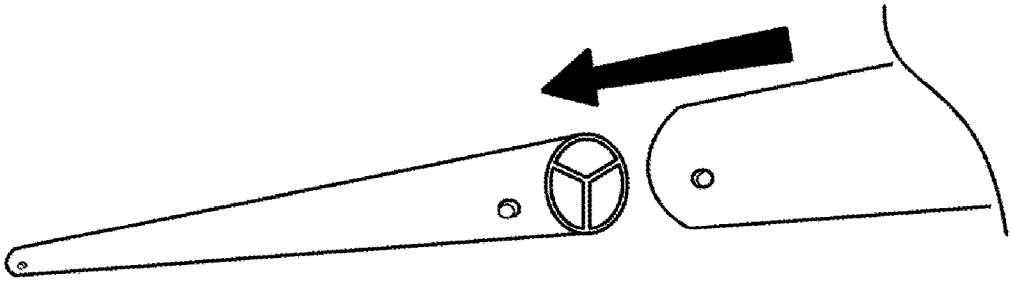
FIG. 18*c* shows the attachment of two similar tubular handles together.
Figure 18D:
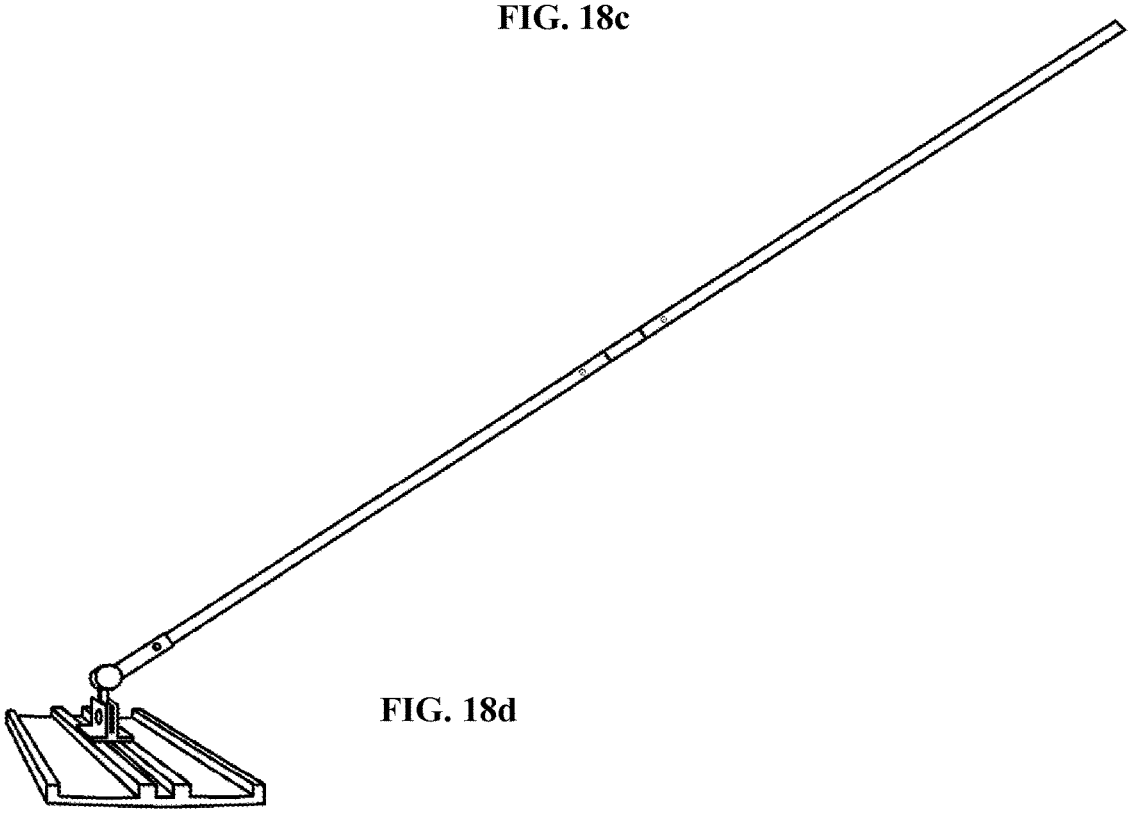
FIG. 18*d* is similar to FIG. 18*b*, wherein the similar tubular handles are joined together using a coupling device.
Figure 18E:
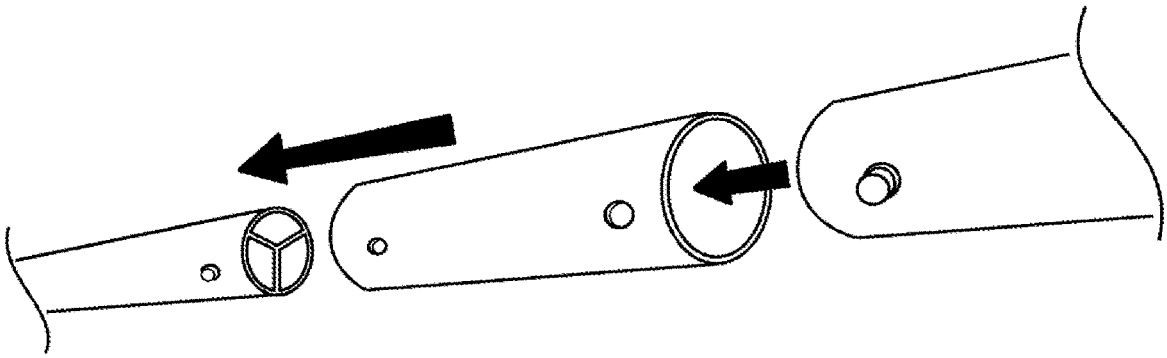
FIG. 18*e* shows the attachment of two similar tubular handles together using a coupling device in accordance with an embodiment of the present invention.
Figure 19A:
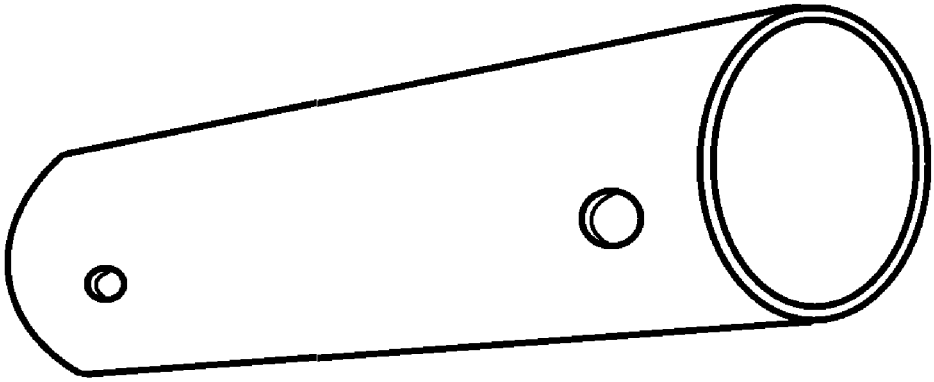
FIG. 19*a* shows a coupling device in accordance with an embodiment of the present invention, wherein the end(s) of the coupling device are female and receive a male end of a tubular handle.
Figure 19B:
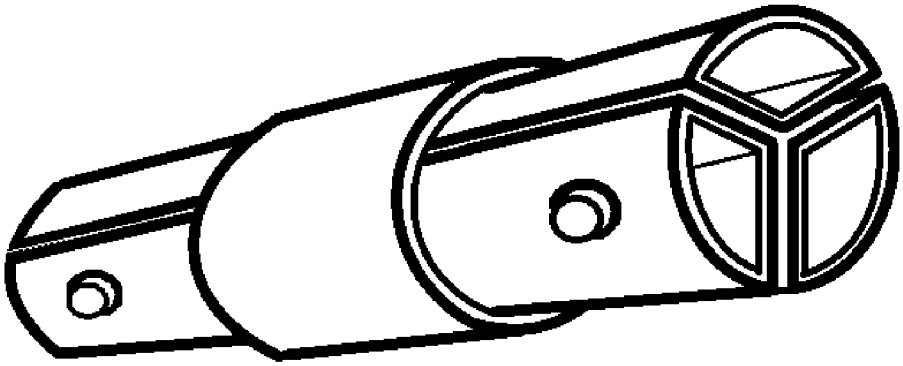
FIG. 19*b* shows a coupling device in accordance with another embodiment of the present invention, wherein the end(s) of the coupling device are male and are received into a female end of a tubular handle.
Figure 19C:
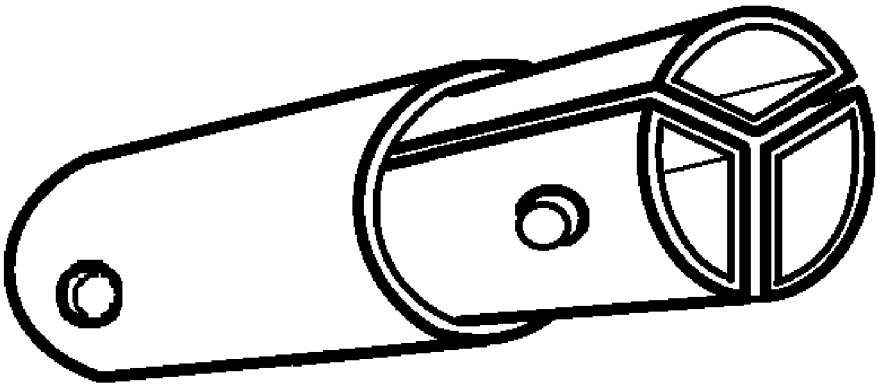
FIG. 19*c* shows a coupling device in accordance with yet another embodiment of the present invention, wherein the coupling device has both a male and female end which matingly engage with a female and male end of a tubular handle, respectively.
Figure 20:
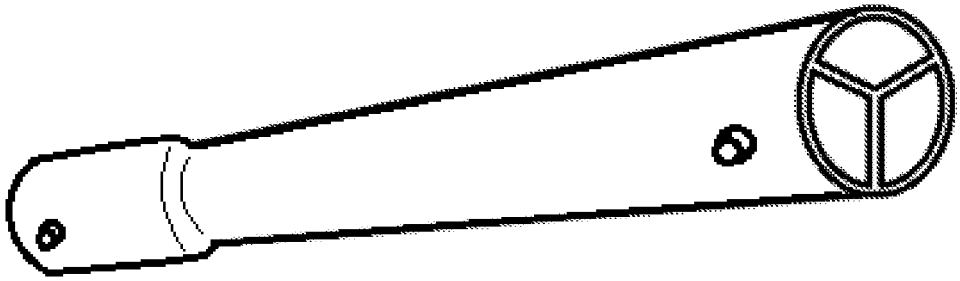
FIG. 20 shows a tubular handle in accordance with an embodiment of the present invention, wherein the tubular handle has both a male and female end for connecting to a similar tubular handle and/or coupling device.
Figure 21:
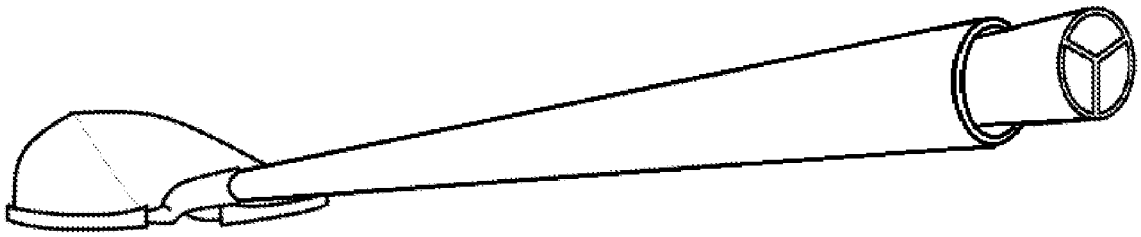
FIG. 21 shows a tubular handle attached to a tool in accordance with an embodiment of the present invention, wherein the handle is at least partially hollow, and a reinforcing device is inserted into the hollow portion of the handle to provide reinforcement for the handle

Further, the benefits provided by a quick-release mechanism can be realized in attaching one or more tubular sections together for increasing the overall length of the handle. As shown in FIGS. 18*c-e*, a quick-releasing device/mechanism may be used to join one or more similar sections of tubular handle together. Persons of ordinary skill will appreciate that the quick-release mechanism may be provided on the tubular section(s) itself (FIG. 18*c*), on a coupling device (FIGS. 19*a-c*) for joining tubular sections, or both. Further, male and female mating ends may be provided in any configuration on the tubular sections and/or coupling devices in order to join similar sections of tubular handles together. Some examples include: a tubular handle in which one side is a male end configured to fit into the female end of another tubular handle; a tubular handle length that has only female ends; a tubular handle length that has only male ends; a tubular handle with at least one male end formed by 'necking down' the handle's male end or ends; and a tubular handle with at least one female end formed by 'expanding' the handle's female end or ends.

Figure 26:
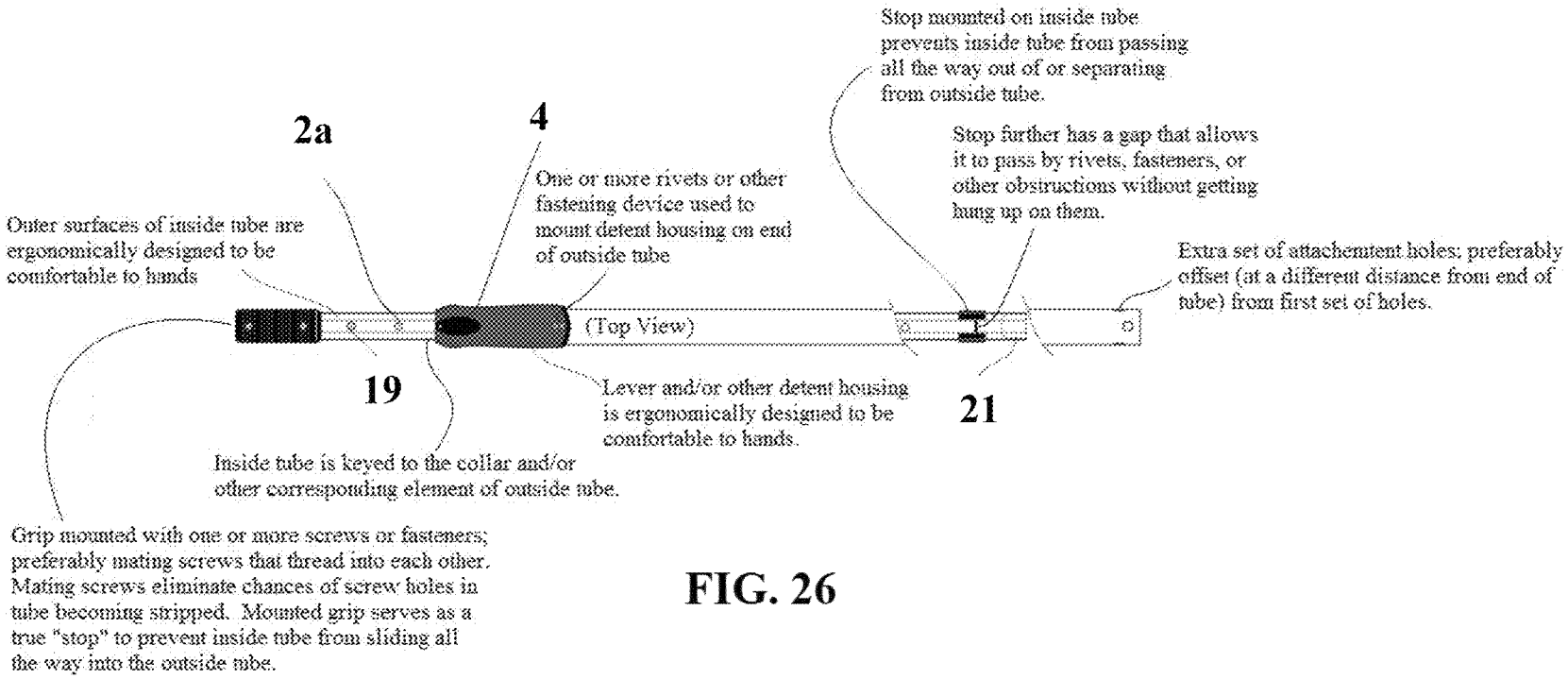
FIG. 26 is a partially cutaway plan view of an assembled telepole embodiment in accordance with the present invention.

Thus, the invention provides an improved telescoping pole with a variety of beneficial uses and applications. In certain embodiments, and as illustrated in FIG. 26, the invention preferably provides a pole with one or more features such as the following:

1. An elongated inside tube element has its outer surfaces ergonomically designed to be comfortable to a user's hands.
2. Holes and/or other 'receiving' or engaging means are provided in the walls of the inside tube and along the inner tube's length to allow engagement/disengagement between concentric lengthwise elements of the assembly, via detent means or otherwise, to facilitate temporarily selecting a desired length for the assembly.
3. The telepole can be adjusted with the use of a detent means or similar device that enables a 'positive' lock/unlock to occur at a selected length/position of the respective generally concentric tubes.
4. One or more rivets or other fastening devices can be used to mount detent housing(s) on an end of outside tube. Alternatives include, without limitation, gluing, welding, etc.
5. A stop mounted on the inside tube prevents the inside tube from passing all the way out of or separating from the outside tube.
6. The stop has a gap or other portion that allows it to pass by rivets, fasteners, or other obstructions without getting hung up on those elements.
7. An extra set of attachment holes is provided, preferably offset (at a different distance from the end of tube) from first set of holes, and/or at a different radial position/orientation.
8. A grip mounted with one or more screws or fasteners; preferably mating screws that thread into each other.
9. Mating screws to help eliminate the risk of screw holes in the tube becoming stripped.
10. A mounted grip that serves as a true 'stop' to prevent the inside tube from sliding all the way "into" the outside tube.
11. Telepoles above having grip on the end, grip further having an opening broad enough to make visible/display reinforcement walls (for marketing or other purposes).
12. Telepoles with grip above, with grip having a clear end that allows customers to see the inside reinforcement walls in the handle (this will allow a user to be forceful with the tool at the grip without irritating or possibly harming his/her hands on an open ended grip).
13. One or more thickened portions or interior walls of inside tube to prevent water from entering one or more hollow areas of the tube(s).
14. The inside tube is keyed to the collar and/or other corresponding element(s) of the outside tube.
15. A lever and/or detent housing is ergonomically designed to be comfortable to users' hands.
16. A plug in the end of the inside tube helps keep the tube and/or the entire assembly relatively watertight and buoyant.

Figure 28:
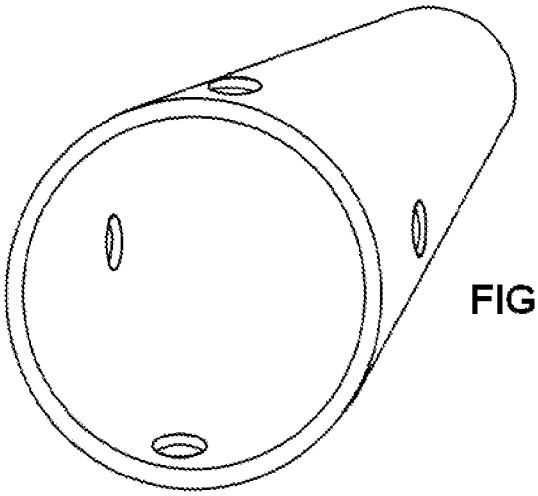
FIG. 28 is generally taken along line 28-28 of FIG. 27, at a slight angle, to show a perspective view of certain embodiments of the offset tool attachment holes of the invention.
Figure 27:
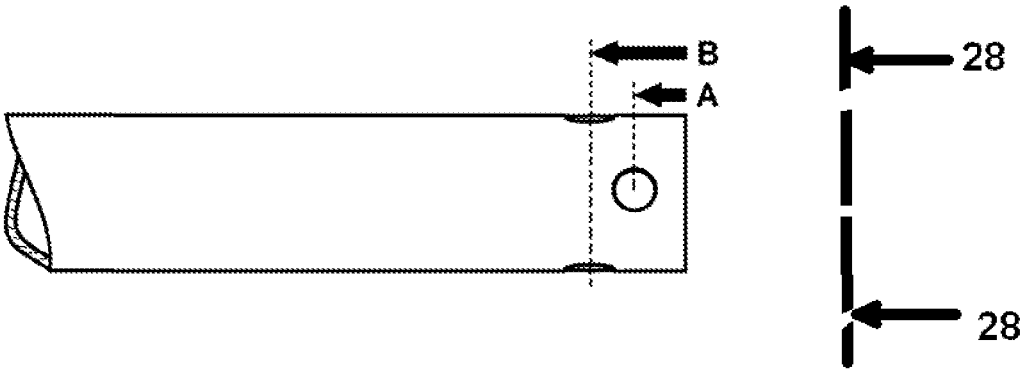
FIG. 27 show a side view of certain embodiments of the offset tool attachment holes of the invention.
Figure 29:
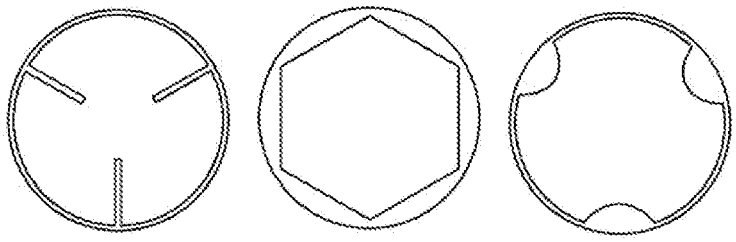
FIG. 29 illustrates cross-sections of some of the many other alternative embodiments of reinforced tube and/or handle elements of the invention.
Figure 30:
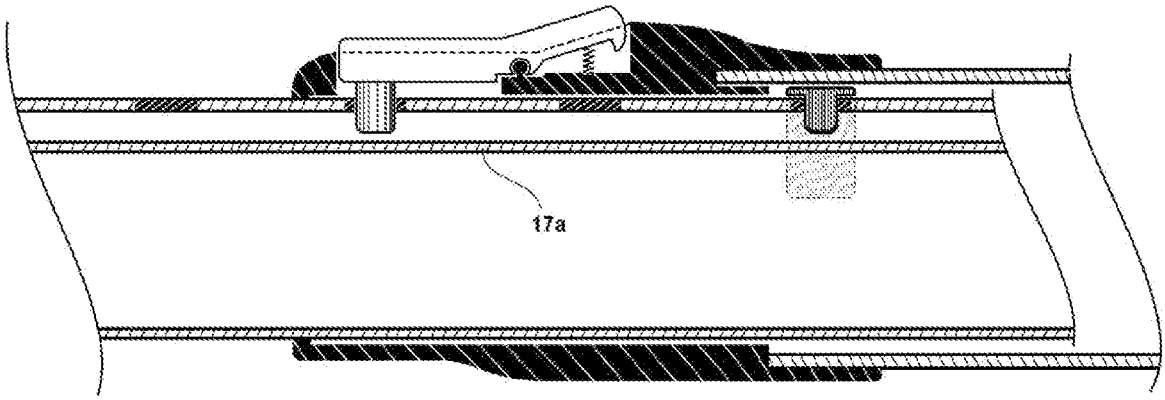
FIG. 30 is a foreshortened sectional view of the engagement structure between the inner and outer tubes, showing (among other things) an embodiment of an inside reinforcement/water barrier wall 17*a* element of the inner tube element.
Figure 32:
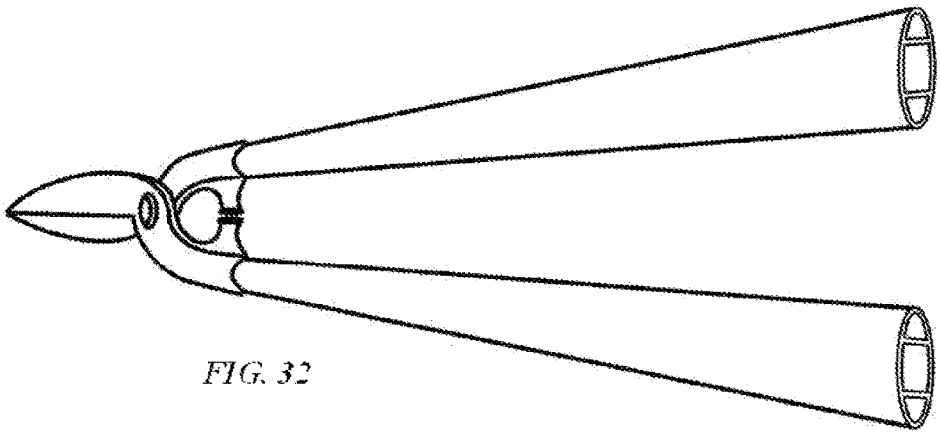
FIGS. 32 and 33 illustrate some of the many multiple-handled tools (clippers/pruners; also, two handles are shown in these figures, but persons of ordinary skill in the art will understand that more complex structures/supports/scaffolding/other applications to which the invention can be put may include more than two such "handles" or similar elongated elements). These embodiments are shown with only a reinforced tubing element on each handle, but persons of ordinary skill in the art will understand that these can be modified to include one or more external tubes that cooperate in the manners described above to provide functionality (telescoping or otherwise) to one or more of the handles, permitting the user to customize the length of the tool handle(s). In certain embodiments, the handles can be fitted with grips similar to those described above.
Figure 33:
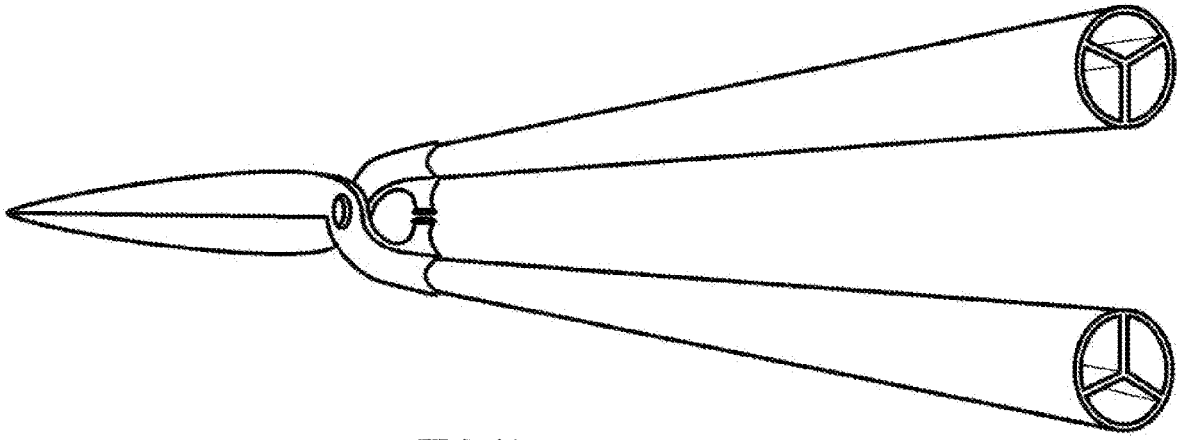
Figure 34:
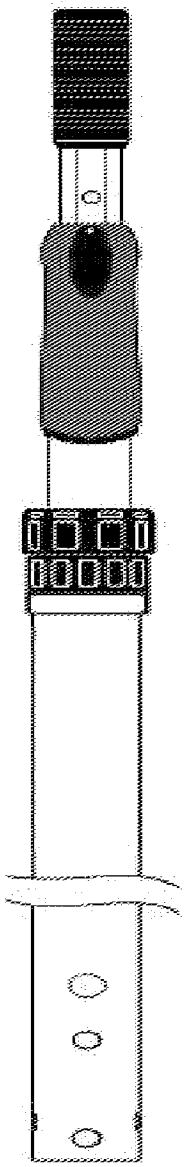
FIG. 34 is a side view of one of the many embodiments of a "plurality of tubes" (three are shown in this figure) embodiments in which the invention may be practiced. More specifically, a 3-piece telescopic pole embodiment of the invention includes, among other things, the following: a) innermost tube keyed to housing and potentially having inner and/or thickened wall to serve as a barrier to prevent water from entering through detent holes, b) lever activated "positive locking" detent means, c) compression fitting for middle-to-outer tube telescopic adjustment, and d) offset second set of tool attachment holes.

In FIGS. 27 and 28, offset attachment holes are illustrated in further detail. Persons of ordinary skill in the art will understand that, among other things, these holes are used to engage a brush or other tool to the end of the pole. Detaching the tool from the pole in prior art systems can involve pressing spring-loaded detents out of engagement with these holes and then quickly rotating or twisting the inner/outer tubes with respect to each other to complete the disengagement. By offsetting the attachment holes as in FIGS. 27 and 28, it is less likely that the tool will accidentally be "reattached" in other holes during such twisting/removal.

A further listing of some of the features of the invention includes the following:

- An adjustable telescopic pole for cleaning swimming pools comprised of at least two tubes (one inside the other) that can be set for use at different lengths and has a detent mechanism that locks the tubes into their relative lengthwise positions.
- Detent mechanism is activated/deactivated by a depressible button.
- Detent mechanism is activated/deactivated by a lever.
- Detent mechanism includes one or more spring type of components
- Locking device includes more than one detent or locking mechanism to lock inside tube in position.
- Outside tube has a collar of some sort, to which the inside tube is keyed to prevent the inside tube from rotating relative to the outside tube.
- Inside tube has holes or other mating elements to receive the locking portion of the detent mechanism (i.e. detent pin/teeth).
- Inside tube has one or more thickened portions along its length to provide strength.
- Thickened portion along length of inside tube further has holes, grooves or other features along it to receive the pin/teeth of a detent mechanism, thickened portion being thick enough that the holes, grooves or other receiving features do not penetrate into a center hollow portion of the inside tube (and thus prevent water from entering the inside area of the inner tube).
- Inside tube has a hollow portion along its length, a specific cross-sectional profile, and one or more interior walls that extend across at least a portion of the hollow inside area of the profile.
- Said one or more interior walls extending across at least a portion of the hollow area to prevent inside tube from filling with water
- Inside tube having one or more interior walls, said one or more interior walls formed separately and inserted into the hollow portion of the tube
- Inside tube having a plug or some other device that serves as a stopper to prevent water from entering the hollow portion of the tube from the tube's end when submerged in a swimming pool or other body of water.
- Inside tube having a cap-like grip on the end opposite the plug
- Grip further being mounted with screws, rivets, etc. to the end of the inside tube to prevent it from being inadvertently bumped off when the inside tube is collapsed lengthwise into the outside tube.
- Screws, rivets, etc. holding grip onto the end of the inside tube are removable and replaceable to enable a user to install a new grip.
- Screws or other removable mounting means that mate to each other (to reduce/prevent the possibility of screw holes in the tube from becoming enlarged or stripped).
- Detent button/lever is mounted in a housing located in collar means.
- Housing has one or more sides that protect at least a portion of the button/lever from being bumped by a user's hands (or some other object) and being accidentally activated/deactivated during use.
- Housing/lever/button mechanism are ergonomically shaped to prevent hands from becoming sore or injured.
- Inside tube is ergonomically designed to prevent hands from becoming sore or injured (this is in contrast to poles having, for example, an inside tube with a sharply-cornered hexagonal cross-section that are, consequently, painful to grasp).
- Inside tube is fitted with a saddle bushing or other type of guide to keep inside tube aligned with inside walls of outer tube.
- Saddle bushing or other type of guide serves as a 'stop' to prevent inside tube from separating from outside tube when the telepole is extended.
- Housing is permanently mounted to outside tube with rivets or some other attachment method.
- Housing is mounted to outside tube in a manner that makes the housing removable/replaceable.
- End of outer tube has additional set of holes about its diameter to receive attachable/detachable tools.
- Additional set of tool attachment holes is placed at a different distance from tube's end than first set of tool attachment holes.
- Telepole with compression locking device, said compression device (as in FIGS. 10, 11, 12*a-d*) having the ability to 'mate' with ribs, ridges, etc. formed on inside tube.
- Telepole with compression locking device with mating ribs, ridges, etc. further having an inside tube that is keyed to the collar mounted on the outside tube.
- Compression locking device on pole with inside tube that is keyed to collar on outside tube (same as above, but without mating ribs/ridges, etc.)
- Compression locking device of above activated by a compression ring, button, lever or other component.
- Compression ring, button, lever or other locking component is at least partially located within a housing.
- Housing from description above has one or more sides to protect at least a portion of the locking device to prevent it from bumping or being bumped and accidentally activated or deactivated.
- Standard telescopic pole with inside tube having one or more inner wall(s) across a portion of its profile (and run substantially the length of the inside tube).
- Pole above having one or more inner wall(s) that extend across a portion of the inside tube's profile, but the wall(s) do not necessarily connect to another side of the profile (i.e., wall(s) extend only ¼ way across the diameter of the tube's profile).
- Plug for compression locking pole having inside tube with one or more inner walls.
- Plug for compression locking pole having inside tube with one or more thickened portions.
- Compression pole having extra set of attachment holes at its end.
- Extra set of attachment holes on compression pole being offset (at different distances from end of tube than first set of attachment holes).
- Compression pole with grip serving as a stop by being mounted on end with screws, mating screws, etc.
- Compression pole with inside tube keyed to collar of outside tube
- Above embodiment(s), further having one or more inner reinforcement walls extending across at least a portion of the inside tube's diameter.
- Above embodiment(s), further having a stop to keep the inside tube from being pulled out of the outside tube.

Above embodiment(s), further having a grip mounted with screws, mating screws, etc.

A telescopic pole comprised of three lengths of tubing, each fitting within the other, having all the same advantages of the invention(s) as described above.

Tool with tubular handle, with reinforcement/strengthening inside wall(s) that extend across the diameter of the tubular handle.

Replacement/replaceable reinforced handle for tools (as above) having reinforcement walls across at least a portion of the handle's diameter.

Tools with two handles (clippers, bolt cutters, etc.).

Tool handles with thickened portions to provide strength.

Tools with handles described above further having a fiberglass, plastic, or other coating.

Tools above having grip on the end, grip further having an opening broad enough to make visible/display reinforcement walls (for marketing or other purposes).

Tools with grip above, with grip having a clear end that allows customers to see the inside reinforcement walls in the handle (this will allow a user to be forceful with the tool at the grip without harming his/her hands on an open ended grip).

Reinforced handles for working with concrete.

Reinforced concrete (or similar application) handles further being attachable to another to make the handle longer.

Attachable reinforced tubes having couplers, quick-lock devices, etc., connecting them and making the handle longer.

A male/female/combo coupler for handles with inside reinforcement walls.

Methods

- Making tools with reinforced handles of the type(s) described herein.
- Making tools with reinforced handles of the type(s) described herein, through an extrusion process.
- Making tools with reinforced handles of the type(s) described herein, through a micro-extrusion process (micro extrusion is useful and/or even necessary for poles having thin walls and relative small (e.g., 1") diameter profile—these can be too difficult to make with standard aluminum extrusion equipment).
- Making tools with reinforced handles, reinforcement walls/components being done in a secondary operation from the initial formation of the tube (i.e. a sliding a sleeve into the inside tube and calling it 'reinforced').

The apparatus and methods of my invention have been described with some particularity, but the specific designs, configurations, and steps disclosed are not to be taken as delimiting of the invention in that various modifications will at once make themselves apparent to those of ordinary skill in the art, all of which will not depart from the essence of the invention, and all such changes and modifications are intended to be encompassed within the appended claims.

The invention claimed is:

1. An elongated telescoping pole apparatus, including:

an elongated outer tube;

an elongated inner tube configured and sized to be slidable within said outer tube;

said inner and outer tubes keyed to prevent relative rotation of the tubes with respect to each other around a central longitudinal axis through the tubes;

said outer tube having first and second ends, said first end of said outer tube having a selectively actuatable detent configured to engage said inner tube at a selected position along the length of said inner tube, said second end of said outer tube having structure for removably attaching a tool;

said inner tube having first and second ends, said first end being received in said slidable relationship within said outer tube, said second end having a grip attached thereto, said selective sliding action of the tubes causing the respective distance between said grip on said inner tube and said actuatable detent on said first end of said outer tube to change;

the lengths of said outer and inner tubes when engaged with each other being sufficient to permit a user gripping said first end of said inner tube to manipulate a swimming pool cleaning tool at the second end of said outer tube against the bottom of a swimming pool while the user is standing on the side of the pool;

in which said inner and outer tubes are aluminum.

2. A telescoping pole apparatus, including:

an outer tube having first and second ends, said first end of the outer tube having a collar associated therewith, said collar containing a selectively actuatable detent, said second end of said outer tube having structure for removably attaching a tool;

an inner tube having first and second ends, said first end of said inner tube including a grip attached to the inner tube for a user to grasp and manipulate the apparatus, said second end of said inner tube being slidably received in the first end of the outer tube through an opening in said collar, said inner tube having a plurality of detent holes positioned to be engaged with said actuatable detent, said inner tube being a single wall tube that is hollow along at least substantially its length between said first and second ends of said inner tube; and said inner tube configured to slide within said outer tube to a selectable position relative to the outer tube, at which position said detent is configured to temporarily engage and hold said inner tube;

in which said inner and outer tubes are aluminum.

3. The apparatus of claim 2, further including a swimming pool cleaning tool attached to said second end of said outer tube using at least one V-clip that can be inserted into two holes positioned opposite each other near the end of said outside tube.

4. The apparatus of claim 2 or claim 3, wherein said structure for removably attaching a tool includes at least two pairs of holes, the holes in a given pair being positioned on opposite sides of said second end of said outer tube at the same position along a lengthwise axis of said outer tube.

5. The apparatus of claim 4, wherein at least one of said pairs of holes is at a different position along a lengthwise axis of said outer tube from another of said pairs.

6. The apparatus of claim 2, in which said outer and inner tubes are keyed to limit their rotation relative to each other around a central longitudinal axis running through the center of said tubes, said keyed relationship existing at all or substantially all of the positions in which said inner tube can be selectably positioned within said outer tube.

7. The apparatus of claim 2, in which said outer and inner tubes are keyed to limit their rotation relative to each other around a central longitudinal axis running through the center of said tubes, said keyed relationship existing between said collar and said inner tube.

8. The apparatus of claim 7, in which said inner tube has a cross-section that at least is keyed to an opening in said collar element through which said inner tube is slidably positioned, and the keyed relationship helps prevent or limit said inner tube from rotating within said collar around said longitudinal axis.

9. The apparatus of claim 7, in which said inner tube has a cross-section that at least is keyed to a compression gasket associated with said outer tube and through which said inner tube is slidably positioned, and the keyed relationship helps prevent or limit said inner tube from rotating within said gasket around said longitudinal axis.

10. The apparatus of claim 2, further including at least one more tube slidably engaged with at least one of said inner tube and/or said outer tube.

11. The apparatus of claim 2, wherein said grip has a larger diameter than the diameter of the inner tube.

12. The apparatus of claim 2, further including an adapter attached to said second end of said outer tube, said adapter having structure for using at least one V-clip to selectively connect pool cleaning tools to said adapter.

13. The apparatus of claim 2, said second end of said outer tube having a sidewall including:

at least two pairs of enclosed perforations through said sidewall and spaced radially from a longitudinal axis of said outer tube, a first perforation of a given pair being spaced radially on one side of the longitudinal axis and the other perforation of the pair being radially spaced on the other side of the longitudinal axis.

14. The apparatus of claim 13, in which the at least two pairs of perforations are spaced radially from the longitudinal axis at the same lengthwise location along a lengthwise axis of said outer tube.

15. The apparatus of claim 13 or claim 14, in which the at least two pairs are positioned rotationally at 90 degrees from each other when measured rotationally around a lengthwise axis of said outer tube.

16. The apparatus of claim 2, wherein said detent holes provide a plurality of selected lengthwise positions for said actuatable detent.

17. The apparatus of claim 2, said inner tube having a thickened wall portion around at least a portion of said inner tube and extending along at least a portion of the length of said inner tube, said detent holes formed at least partially in said thickened portion.

18. The apparatus of claim 2, said detent including a spring-actuated lever lock.

19. The apparatus of claim 2, said inner and outer tubes formed from a relatively lightweight material such as aluminum.

20. A telescoping pole apparatus, including:

an outer tube having first and second ends, said first end of said outer tube having a collar associated therewith, said collar containing a selectively actuatable detent, said second end of said outer tube having structure for removably attaching a tool;

an inner tube having first and second ends, said first end of said inner tube including a grip attached to the inner tube for a user to grasp and manipulate the apparatus;

an intermediate tube slidably interposed between said inner and outer tubes, said intermediate tube having first and second ends, said first end of said intermediate tube slidably received in the first end of said outer tube through an opening in said collar, said intermediate tube having a plurality of detent holes positioned to be engaged with said actuatable detent of said outer tube's collar, said second end of said intermediate tube having a collar associated therewith, said collar containing a selectively actuatable detent;

said second end of said inner tube being slidably received in the second end of said intermediate tube through an opening in said intermediate tube's collar, said inner tube having a plurality of detent holes positioned to be engaged with said actuatable detent of said intermediate tube's collar;

said intermediate tube configured to slide within said outer tube to a selectable position relative to said outer tube, at which position said detent of said outer tube is configured to temporarily engage and hold said intermediate tube; and said inner tube configured to slide within said intermediate tube to a selectable position relative to said intermediate tube, at which position said detent of said intermediate tube is configured to temporarily engage and hold said inner tube;

in which said inner and outer and intermediate tubes are aluminum.

21. The apparatus of claim 1 or claim 2 or claim 20, in which the cross section of said inner tube is more round-shaped than a hexagon.

22. The apparatus of claim 1 or claim 2 or claim 20, in which the cross section of said inner tube is generally round with at least one generally flat portion.

23. The apparatus of claim 1 or claim 2 or claim 20, in which the cross section of said inner tube is round except for one generally flat segment, said flat segment functioning to key said inner tube against rotation within said outer tube.

24. The apparatus of claim 1 or claim 2 or claim 20, in which said inner tube includes a thickened wall portion.

25. The apparatus of claim 24, in which said plurality of detent holes are formed in said thickened wall portion of said inner tube.

26. An improved telepole device, comprising:

an outer tube element having first and second ends, said first end of the outer tube element having a collar element associated therewith, said collar element containing a detent means, said second end of the outer tube having attachment means for removably attaching a tool;

an inner tube element having first and second ends;

said second end of said inner tube element being received in the first end of the outer tube through an opening in said collar element;

wherein said inner tube element is configured to readily slide within said outer tube element to a selected position along the length of the outer tube, and wherein said detent means is configured to temporarily lock the inner tube in that selected position within the outer tube;

in which said inner and outer tube elements are aluminum.

27. The telepole of claim 26, wherein the tool is a swimming pool cleaning tool.

28. The telepole of claim 26, wherein the tool is a concrete finishing tool.

29. The telepole of claim 26, wherein said inner tube element has a cross-section that is generally round with at least one flat side, and said collar is keyed to engage said at least one flat side and thereby prevent rotation of said inner and outer tubes relative to each other.

30. The telepole of claim 26, said attachment means for removably attaching a tool including a sidewall integrally formed as part of said second end of said outer tube, said sidewall including at least one pair of enclosed perforations through said sidewall and spaced radially from a longitudinal central axis of said outer tube, a first perforation of said at least one pair being spaced radially on one side of said longitudinal axis and the other perforation of the at least one pair being radially spaced on the other side of said longitudinal axis, said at least one pair of perforations sized and positioned to receive corresponding protruding elements on a flexible V-clip attaching structure in the tool, to thereby engage the tool with said outside tube.

31. A telescoping pole apparatus, including:

an outer tube having first and second ends, said first end of the outer tube having a collar associated therewith, said collar containing a selectively actuatable detent, said second end of said outer tube having structure for removably attaching a tool;

an inner tube having first and second ends, said first end of said inner tube including a grip attached to the inner tube for a user to grasp and manipulate the apparatus, said second end of said inner tube being slidably received in the first end of the outer tube through an opening in said collar, said inner tube having a plurality of detent holes positioned to be engaged with said actuatable detent, said inner tube being a single wall tube that is hollow along at least substantially its length between said first and second ends of said inner tube; and said inner tube configured to slide within said outer tube to a selectable position relative to the outer tube, at which position said detent is configured to temporarily engage and hold said inner tube;

said structure for removably attaching a tool including a sidewall integrally formed as part of said second end of said outer tube, said sidewall including at least one pair of enclosed perforations through said sidewall and spaced radially from a longitudinal central axis of said outer tube, a first perforation of said at least one pair being spaced radially on one side of said longitudinal axis and the other perforation of the at least one pair being radially spaced on the other side of said longitudinal axis, said at least one pair of perforations sized and positioned to receive corresponding protruding elements on a flexible V-clip attaching structure in the tool, to thereby engage the tool with said outside tube.

32. An improved telepole device, comprising:

an outer tube element having first and second ends, said first end of the outer tube element having a collar element associated therewith, said collar element containing a detent means, said second end of the outer tube having attachment means for removably attaching a tool;

an inner tube element having first and second ends;

said second end of said inner tube element being received in the first end of the outer tube through an opening in said collar element;

wherein said inner tube element is configured to readily slide within said outer tube element to a selected position along the length of the outer tube, and wherein said detent means is configured to temporarily lock the inner tube in that selected position within the outer tube;

said attachment means for removably attaching a tool including a sidewall integrally formed as part of said second end of said outer tube, said sidewall including at least one pair of enclosed perforations through said sidewall and spaced radially from a longitudinal central axis of said outer tube, a first perforation of said at least one pair being spaced radially on one side of said longitudinal axis and the other perforation of the at least one pair being radially spaced on the other side of said longitudinal axis, said at least one pair of perforations sized and positioned to receive corresponding protruding elements on a flexible V-clip attaching structure in the tool, to thereby engage the tool with said outside tube.

* * * * *